US011026497B2

(12) United States Patent
Yang et al.

(10) Patent No.: US 11,026,497 B2
(45) Date of Patent: Jun. 8, 2021

(54) COMPACT MIRROR

(71) Applicant: simplehuman, LLC, Torrance, CA (US)

(72) Inventors: Frank Yang, Rancho Palos Verdes, CA (US); Di-Fong Chang, Torrance, CA (US); Guy Cohen, Marina Del Rey, CA (US)

(73) Assignee: simplehuman, LLC, Torrance, CA (US)

( * ) Notice: Subject to any disclaimer, the term of this patent is extended or adjusted under 35 U.S.C. 154(b) by 125 days.

(21) Appl. No.: 16/274,734

(22) Filed: Feb. 13, 2019

(65) Prior Publication Data

US 2019/0246772 A1 Aug. 15, 2019

Related U.S. Application Data

(60) Provisional application No. 62/630,788, filed on Feb. 14, 2018, provisional application No. 62/640,147, filed on Mar. 8, 2018.

(51) Int. Cl.
*A45D 42/10* (2006.01)
*A45D 42/04* (2006.01)
(Continued)

(52) U.S. Cl.
CPC ..... *A45D 42/10* (2013.01); *A45C 11/24* (2013.01); *A45D 42/04* (2013.01); *F21V 33/004* (2013.01)

(58) Field of Classification Search
CPC ..... A45D 42/04; A45D 42/10; F21V 33/004; A45C 11/24
See application file for complete search history.

(56) References Cited

U.S. PATENT DOCUMENTS

D44,537 S 8/1913 McIsaac
D65,759 S 10/1924 Short
(Continued)

FOREIGN PATENT DOCUMENTS

CN 3044427D 5/1996
CN 2379638 Y 5/2000
(Continued)

OTHER PUBLICATIONS

U.S. Appl. No. 29/689,860, filed May 2, 2019, Yang et al.
(Continued)

*Primary Examiner* — Thomas M Sember
(74) *Attorney, Agent, or Firm* — Knobbe Martens Olson & Bear, LLP

(57) ABSTRACT

A mirror system can include a mirror assembly and a protective portion, such as a holder or cover. A mirror assembly can include a housing portion, a mirror, a light source, a light conveying channel, and an orienting structure. In some embodiments, the mirror assembly includes a component interaction actuator, such as a switch, configured to automatically activate or deactivate when two components in the mirror system interact or cease interacting. In some embodiments, the mirror assembly is configured to turn on upon removal of at least a portion of the mirror assembly from at least a portion of the protective portion and to turn off upon at least a portion of the mirror assembly being received by at least a portion of the protective portion. In some embodiments, a user can hold the mirror assembly and use the orienting structure as a finger-retaining portion. In some embodiments, the user can use the orienting structure as a stand for the mirror assembly. In some embodiments, the user can use the protective portion as a stand for the mirror assembly.

21 Claims, 17 Drawing Sheets

(51) Int. Cl.
*F21V 33/00* (2006.01)
*A45C 11/24* (2006.01)

(56) References Cited

U.S. PATENT DOCUMENTS 1,541,451 A 6/1925 Wallace
2,004,166 A 6/1935 Low
2,235,281 A 3/1941 Carver
2,292,059 A 8/1942 Charles
D163,481 S 5/1951 Rauh
2,687,674 A 8/1954 Emilea
D208,234 S 8/1967 Ely
D209,077 S 10/1967 Andre
D213,392 S 2/1969 Andre
D216,414 S 12/1969 Hanson
3,623,356 A 11/1971 Bisberg
3,732,702 A 5/1973 Desch
3,794,828 A 2/1974 Arpino
3,949,767 A 4/1976 Rose
D243,301 S 2/1977 Ravn
D243,478 S 2/1977 Jones
D254,208 S 2/1980 Breslow
4,278,870 A 7/1981 Carleton et al.
D261,845 S 11/1981 Wachtel
D266,028 S 8/1982 Boyd
4,491,899 A * 1/1985 Fleming ..... B60J 3/0282 296/97.5
D284,483 S 7/1986 Yang
D290,662 S 7/1987 Basil et al.
D307,358 S 4/1990 Gerton
D309,833 S 8/1990 Wahl
D317,531 S 6/1991 Evans
5,025,354 A 6/1991 Kondo
5,164,861 A 11/1992 Katz
D335,580 S 5/1993 Gaullier
5,267,786 A 12/1993 Aisley
5,392,162 A 2/1995 Glucksman
D378,159 S 2/1997 Mulkey
D379,125 S 5/1997 Simjian
D391,773 S 3/1998 Zaidman et al.
D409,003 S 5/1999 Scavini
5,979,976 A 11/1999 Ferencik
5,984,485 A 11/1999 Poli et al.
6,042,242 A 3/2000 Chang
D425,313 S 5/2000 Zadro
D426,182 S 6/2000 Brown
6,106,121 A 8/2000 Buckley et al.
D431,375 S 10/2000 Zadro
6,158,877 A 12/2000 Zadro
6,206,530 B1 3/2001 Eberts
D442,371 S 5/2001 Eberts
6,241,357 B1 6/2001 Lee
6,270,240 B1 8/2001 Inoue
6,273,585 B1 8/2001 Wu
6,305,809 B1 10/2001 Zadro
D454,701 S 3/2002 Eric
D459,094 S 6/2002 Stone et al.
6,420,682 B1 7/2002 Sellgren et al.
6,466,826 B1 10/2002 Nishihira et al.
D465,490 S 11/2002 Wei
6,553,123 B1 * 4/2003 Dykstra ..... B60R 1/008 381/365
D474,432 S 5/2003 Good
6,560,027 B2 5/2003 Meine
6,594,630 B1 7/2003 Zlokarnik et al.
6,604,836 B2 8/2003 Carlucci et al.
6,676,272 B2 1/2004 Chance
D486,964 S 2/2004 Prince et al.
D488,626 S 4/2004 Kruger
D492,230 S 6/2004 Berger
6,830,154 B2 12/2004 Zadro
6,848,822 B2 2/2005 Ballen et al.
D505,555 S 5/2005 Snell
6,886,351 B2 5/2005 Palfy et al.
D508,883 S 8/2005 Falconer
D509,369 S 9/2005 Snell
D511,413 S 11/2005 Yue
6,961,168 B2 11/2005 Agrawal et al.
D512,841 S 12/2005 Dirks
7,004,599 B2 2/2006 Mullani
7,048,406 B1 5/2006 Shih
7,054,668 B2 5/2006 Endo et al.
D524,469 S 7/2006 Pitot et al.
7,090,378 B1 8/2006 Zadro
D532,981 S 12/2006 Zadro
D540,549 S 4/2007 Yue
7,233,154 B2 6/2007 Groover et al.
D546,567 S 7/2007 Bhavnani
D547,555 S 7/2007 Lo et al.
D558,987 S 1/2008 Gildersleeve
D562,571 S 2/2008 Pitot
7,341,356 B1 3/2008 Zadro
7,347,573 B1 3/2008 Isler
7,349,144 B2 3/2008 Varaprasad et al.
D568,081 S 5/2008 Thompson et al.
D569,671 S 5/2008 Thompson et al.
7,370,982 B2 5/2008 Bauer et al.
D572,024 S 7/2008 Shapiro
7,393,115 B2 7/2008 Tokushita et al.
D574,159 S 8/2008 Howard
7,417,699 B2 8/2008 Yun et al.
7,435,928 B2 10/2008 Platz
7,446,924 B2 11/2008 Schofield et al.
7,455,412 B2 11/2008 Rottcher
D582,984 S 12/2008 Mininger et al.
D584,516 S 1/2009 Otomo
7,513,476 B1 4/2009 Huang
7,551,354 B2 6/2009 Horsten et al.
7,570,413 B2 8/2009 Tonar et al.
7,589,893 B2 9/2009 Rottcher
7,621,651 B2 11/2009 Chan et al.
7,626,655 B2 12/2009 Yamazaki et al.
7,636,195 B2 12/2009 Nieuwkerk et al.
7,651,229 B1 1/2010 Rimback et al.
7,679,809 B2 3/2010 Tonar et al.
7,728,927 B2 6/2010 Nieuwkerk et al.
7,805,260 B2 9/2010 Mischel, Jr. et al.
D625,930 S 10/2010 Merica
7,813,023 B2 10/2010 Baur
7,813,060 B1 10/2010 Bright et al.
7,826,123 B2 11/2010 McCabe et al.
7,853,414 B2 12/2010 Mischel, Jr. et al.
7,855,755 B2 12/2010 Weller et al.
7,859,737 B2 12/2010 McCabe et al.
7,859,738 B2 12/2010 Baur et al.
7,864,399 B2 1/2011 McCabe et al.
D635,009 S 3/2011 Paterson
7,898,719 B2 3/2011 Schofield et al.
7,903,335 B2 3/2011 Nieuwkerk et al.
7,916,129 B2 3/2011 Lin et al.
7,916,380 B2 3/2011 Tonar et al.
7,953,648 B2 5/2011 Vock
D639,077 S 6/2011 DeBretton Gordon
7,978,393 B2 7/2011 Tonar et al.
8,004,741 B2 8/2011 Tonar et al.
D647,444 S 10/2011 Manukyan et al.
D649,790 S 12/2011 Pitot
8,083,386 B2 12/2011 Lynam
D652,220 S 1/2012 Pitot
8,099,247 B2 1/2012 Mischel, Jr. et al.
D656,979 S 4/2012 Yip et al.
D657,425 S 4/2012 Podd
D657,576 S 4/2012 Pitot
8,154,418 B2 4/2012 Peterson et al.
8,162,502 B1 4/2012 Zadro
D658,604 S 5/2012 Egawa et al.
D660,367 S 5/2012 Podd
D660,368 S 5/2012 Podd
D660,369 S 5/2012 Podd
8,179,236 B2 5/2012 Weller et al.
8,179,586 B2 5/2012 Schofield et al.
8,194,133 B2 6/2012 DeWind et al.
8,228,588 B2 7/2012 McCabe et al.
D665,030 S 8/2012 Podd

(56) References Cited

U.S. PATENT DOCUMENTS

| | | | |
|---|---|---|---|
| D666,010 | S | 8/2012 | Farley |
| D670,087 | S | 11/2012 | Walker |
| 8,335,032 | B2 | 12/2012 | McCabe et al. |
| 8,348,441 | B1 | 1/2013 | Skelton |
| 8,356,908 | B1 | 1/2013 | Zadro |
| 8,379,289 | B2 | 2/2013 | Schofield et al. |
| 8,382,189 | B2 | 2/2013 | Li et al. |
| 8,393,749 | B1 | 3/2013 | Daicos |
| 8,400,704 | B2 | 3/2013 | McCabe et al. |
| D679,101 | S | 4/2013 | Pitot |
| D679,102 | S | 4/2013 | Gilboe et al. |
| D680,755 | S | 4/2013 | Gilboe et al. |
| 8,503,062 | B2 | 8/2013 | Baur et al. |
| 8,506,096 | B2 | 8/2013 | McCabe et al. |
| 8,508,832 | B2 | 8/2013 | Baumann et al. |
| 8,511,841 | B2 | 8/2013 | Varaprasad et al. |
| D688,883 | S | 9/2013 | Gilboe et al. |
| D689,701 | S | 9/2013 | Mischel, Jr. et al. |
| 8,559,092 | B2 | 10/2013 | Bugno et al. |
| 8,559,093 | B2 | 10/2013 | Varaprasad et al. |
| 8,585,273 | B2 | 11/2013 | Pokrovskiy et al. |
| D699,448 | S | 2/2014 | Yang et al. |
| D699,952 | S | 2/2014 | Yang et al. |
| 8,649,082 | B2 | 2/2014 | Baur |
| D701,050 | S | 3/2014 | Yang et al. |
| D701,507 | S | 3/2014 | Cope |
| 8,705,161 | B2 | 4/2014 | Schofield et al. |
| 8,727,547 | B2 | 5/2014 | McCabe et al. |
| D707,454 | S | 6/2014 | Pitot |
| 8,743,051 | B1 | 6/2014 | Moy et al. |
| D711,871 | S | 8/2014 | Daniel |
| D711,874 | S | 8/2014 | Cope |
| 8,797,627 | B2 | 8/2014 | McCabe et al. |
| D712,963 | S | 9/2014 | Fleet |
| 8,880,360 | B2 | 11/2014 | Mischel, Jr. et al. |
| 8,910,402 | B2 | 12/2014 | Mischel, Jr. et al. |
| D727,630 | S | 4/2015 | Zadro |
| D729,525 | S | 5/2015 | Tsai |
| D729,527 | S | 5/2015 | Tsai |
| D730,065 | S | 5/2015 | Tsai |
| 9,090,211 | B2 | 7/2015 | McCabe et al. |
| D736,001 | S | 8/2015 | Yang et al. |
| D737,059 | S | 8/2015 | Tsai |
| D737,060 | S | 8/2015 | Yang et al. |
| 9,105,202 | B2 | 8/2015 | Mischel, Jr. et al. |
| D737,580 | S | 9/2015 | Tsai |
| D738,118 | S | 9/2015 | Gyanendra et al. |
| 9,170,353 | B2 | 10/2015 | Chang |
| 9,173,509 | B2 | 11/2015 | Mischel, Jr. et al. |
| 9,174,578 | B2 | 11/2015 | Uken et al. |
| 9,205,780 | B2 | 12/2015 | Habibi et al. |
| 9,232,846 | B2 | 1/2016 | Fung |
| 9,254,789 | B2 | 2/2016 | Anderson et al. |
| D751,829 | S | 3/2016 | Yang et al. |
| D754,446 | S | 4/2016 | Yang et al. |
| 9,327,649 | B2 | 5/2016 | Habibi |
| 9,341,914 | B2 | 5/2016 | McCabe et al. |
| D764,592 | S | 8/2016 | Zenoff |
| 9,499,103 | B2 | 11/2016 | Han |
| 9,528,695 | B2 | 12/2016 | Adachi et al. |
| D776,945 | S | 1/2017 | Yang |
| D779,836 | S | 2/2017 | Bailey |
| D785,345 | S | 5/2017 | Yang et al. |
| 9,638,410 | B2 | 5/2017 | Yang et al. |
| 9,694,751 | B2 | 7/2017 | Lundy, Jr. et al. |
| 9,709,869 | B2 | 7/2017 | Baumann et al. |
| D793,099 | S | 8/2017 | Bailey |
| D801,060 | S | 10/2017 | Hollinger |
| 9,827,912 | B2 | 11/2017 | Olesen et al. |
| 9,845,537 | B2 | 12/2017 | Mischel, Jr. et al. |
| 9,878,670 | B2 | 1/2018 | McCabe et al. |
| 9,897,306 | B2 | 2/2018 | Yang et al. |
| 9,921,390 | B1 | 3/2018 | Mischel, Jr. et al. |
| 9,933,595 | B1 | 4/2018 | Mischel, Jr. et al. |
| D816,350 | S | 5/2018 | Yang et al. |
| 10,016,045 | B1 | 7/2018 | Hollinger |
| 10,023,123 | B2 | 7/2018 | Takada et al. |
| 10,029,616 | B2 | 7/2018 | McCabe et al. |
| 10,035,461 | B2 | 7/2018 | Lin et al. |
| D825,940 | S | 8/2018 | Liu |
| 10,076,176 | B2 | 9/2018 | Yang et al. |
| D845,652 | S | 4/2019 | Yang et al. |
| D846,288 | S | 4/2019 | Yang et al. |
| D848,158 | S | 5/2019 | Yang et al. |
| D874,161 | S | 2/2020 | Yang et al. |
| 10,702,043 | B2 | 7/2020 | Yang et al. |
| 10,746,394 | B2 | 8/2020 | Yang et al. |
| 10,869,537 | B2 | 12/2020 | Yang et al. |
| 2002/0196333 | A1 | 12/2002 | Gorischek |
| 2003/0030063 | A1 | 2/2003 | Sosniak et al. |
| 2003/0031010 | A1 | 2/2003 | Sosniak et al. |
| 2004/0020509 | A1 | 2/2004 | Waisman |
| 2004/0125592 | A1 | 7/2004 | Nagakubo et al. |
| 2004/0156133 | A1 | 8/2004 | Vernon |
| 2004/0173498 | A1 | 9/2004 | Lee |
| 2005/0036300 | A1 | 2/2005 | Dowling et al. |
| 2005/0068646 | A1 | 3/2005 | Lev et al. |
| 2005/0243556 | A1 | 11/2005 | Lynch |
| 2005/0270769 | A1 | 12/2005 | Smith |
| 2005/0276053 | A1 | 12/2005 | Nortrup et al. |
| 2006/0077654 | A1 | 4/2006 | Krieger et al. |
| 2006/0132923 | A1 | 6/2006 | Hsiao et al. |
| 2006/0184993 | A1 | 8/2006 | Goldthwaite et al. |
| 2006/0186314 | A1 | 8/2006 | Leung |
| 2007/0097672 | A1 | 5/2007 | Benn |
| 2007/0159846 | A1 | 7/2007 | Nishiyama et al. |
| 2007/0183037 | A1 | 8/2007 | De Boer et al. |
| 2007/0263999 | A1 | 11/2007 | Keam |
| 2007/0297189 | A1 | 12/2007 | Wu et al. |
| 2008/0078796 | A1 | 4/2008 | Parsons |
| 2008/0130305 | A1 | 6/2008 | Wang et al. |
| 2008/0244940 | A1 | 10/2008 | Mesika |
| 2008/0258110 | A1 | 10/2008 | Oshio |
| 2008/0265799 | A1 | 10/2008 | Sibert |
| 2008/0271354 | A1 | 11/2008 | Bostrom |
| 2008/0294012 | A1 | 11/2008 | Kurtz et al. |
| 2008/0298080 | A1 | 12/2008 | Wu et al. |
| 2009/0027902 | A1 | 1/2009 | Fielding et al. |
| 2009/0194670 | A1 | 8/2009 | Rains, Jr. et al. |
| 2009/0207339 | A1 | 8/2009 | Ajichi et al. |
| 2009/0213604 | A1 | 8/2009 | Uken |
| 2009/0244740 | A1 | 10/2009 | Takayanagi et al. |
| 2009/0301927 | A1 | 12/2009 | Fvlbrook et al. |
| 2010/0033988 | A1 | 2/2010 | Chiu et al. |
| 2010/0118422 | A1 | 5/2010 | Holacka |
| 2010/0118520 | A1 | 5/2010 | Stern et al. |
| 2010/0296298 | A1 | 11/2010 | Martin, Jr. |
| 2010/0309159 | A1 | 12/2010 | Roettcher |
| 2011/0058269 | A1 | 3/2011 | Su |
| 2011/0074225 | A1 | 3/2011 | Delnoij et al. |
| 2011/0080374 | A1 | 4/2011 | Feng et al. |
| 2011/0194200 | A1 | 8/2011 | Greenlee |
| 2011/0211079 | A1 | 9/2011 | Rolston |
| 2011/0273659 | A1 | 11/2011 | Sobecki |
| 2011/0283577 | A1 | 11/2011 | Cornelissen et al. |
| 2012/0056738 | A1 | 3/2012 | Lynam |
| 2012/0080903 | A1 | 4/2012 | Li et al. |
| 2012/0081915 | A1 | 4/2012 | Foote et al. |
| 2012/0229789 | A1 | 9/2012 | Kang et al. |
| 2012/0307490 | A1 | 12/2012 | Ellis |
| 2013/0026512 | A1 | 1/2013 | Tsai |
| 2013/0077292 | A1 | 3/2013 | Zimmerman |
| 2013/0120989 | A1 | 5/2013 | Sun et al. |
| 2013/0190845 | A1 | 7/2013 | Liu et al. |
| 2014/0240964 | A1 | 8/2014 | Adachi et al. |
| 2015/0060431 | A1 | 3/2015 | Yang et al. |
| 2015/0203970 | A1 | 7/2015 | Mischel, Jr. et al. |
| 2015/0205110 | A1 | 7/2015 | Mischel, Jr. et al. |
| 2015/0305113 | A1 | 10/2015 | Ellis |
| 2016/0045015 | A1 | 2/2016 | Baldwin |
| 2016/0070085 | A1 | 3/2016 | Mischel, Jr. et al. |
| 2016/0082890 | A1 | 3/2016 | Habibi et al. |
| 2016/0178964 | A1 | 6/2016 | Sakai et al. |
| 2016/0193902 | A1 | 7/2016 | Hill et al. |

(56) References Cited

U.S. PATENT DOCUMENTS

| | | | |
|---|---|---|---|
| 2016/0200256 | A1 | 7/2016 | Takada et al. |
| 2016/0243989 | A1 | 8/2016 | Habibi |
| 2017/0028924 | A1 | 2/2017 | Baur et al. |
| 2017/0139302 | A1 | 5/2017 | Tonar |
| 2017/0158139 | A1 | 6/2017 | Tonar et al. |
| 2017/0190290 | A1 | 7/2017 | Lin et al. |
| 2017/0285392 | A1 | 10/2017 | Hirata et al. |
| 2017/0297495 | A1 | 10/2017 | Lundy, Jr. et al. |
| 2017/0297498 | A1 | 10/2017 | Larson et al. |
| 2017/0313251 | A1 | 11/2017 | Uken et al. |
| 2017/0349102 | A1 | 12/2017 | Habibi |
| 2018/0012526 | A1 | 1/2018 | Dunn et al. |
| 2018/0015880 | A1 | 1/2018 | Olesen et al. |
| 2018/0017823 | A1 | 1/2018 | Saenger Nayver et al. |
| 2018/0032227 | A1 | 2/2018 | Broxson |
| 2018/0050641 | A1 | 2/2018 | Lin et al. |
| 2018/0105114 | A1 | 4/2018 | Geerlings et al. |
| 2018/0147993 | A1 | 5/2018 | McCabe et al. |
| 2018/0172265 | A1 | 6/2018 | Yang et al. |
| 2018/0263362 | A1 | 9/2018 | Yang et al. |
| 2019/0000219 | A1 | 1/2019 | Yang et al. |
| 2019/0054863 | A1 | 2/2019 | Roth |
| 2019/0291647 | A1 | 9/2019 | Yang et al. |
| 2020/0085170 | A1 | 3/2020 | Yang et al. |
| 2020/0268127 | A1 | 8/2020 | Yang et al. |
| 2020/0278514 | A1 | 9/2020 | Yang et al. |

FOREIGN PATENT DOCUMENTS

| | | | |
|---|---|---|---|
| CN | 3357935D | | 3/2004 |
| CN | 2852806 | Y | 1/2007 |
| CN | 2925206 | Y | 7/2007 |
| CN | 300746709 D | | 2/2008 |
| CN | 101160003 | A | 4/2008 |
| CN | 101382025 | A | 3/2009 |
| CN | 300973066 | S | 8/2009 |
| CN | 300983799 | S | 8/2009 |
| CN | 300990023 | S | 8/2009 |
| CN | 301001894 | S | 9/2009 |
| CN | 301108997 | S | 1/2010 |
| CN | 301209880 | S | 5/2010 |
| CN | 101787830 | A | 7/2010 |
| CN | 301278203 | S | 7/2010 |
| CN | 301340032 | S | 9/2010 |
| CN | 301502988 | S | 4/2011 |
| CN | 102057756 | A | 5/2011 |
| CN | 301583101 | S | 6/2011 |
| CN | 301811715 | S | 1/2012 |
| CN | 302103915 | S | 10/2012 |
| CN | 302140631 | S | 10/2012 |
| CN | 302140632 | S | 10/2012 |
| CN | 302337970 | S | 3/2013 |
| CN | 302363850 | S | 3/2013 |
| CN | 302396166 | S | 4/2013 |
| CN | 302442518 | S | 5/2013 |
| CN | 103300590 | A | 9/2013 |
| CN | 302638575 | S | 11/2013 |
| CN | 302668773 | S | 12/2013 |
| CN | 106377049 | A | 2/2017 |
| CN | 108185741 | A | 6/2018 |
| CN | 207626762 | U | 7/2018 |
| DE | 2924529 | A1 | 1/1981 |
| DE | 29904039 | U1 | 6/1999 |
| DE | 20014279 | U1 | 2/2001 |
| DE | 102004042929 | A1 | 3/2006 |
| DE | 202007013393 | U1 | 12/2007 |
| DE | 102006060781 | A1 | 4/2008 |
| DE | 202009004795 | U1 | 9/2009 |
| DE | 202010000170 | U1 | 7/2010 |
| DE | 202012103555 | U1 | 2/2014 |
| EP | 1792553 | A2 | 6/2007 |
| FR | 2 788 951 | | 8/2000 |
| JP | 55-129073 | | 10/1980 |
| JP | 59-166769 | | 11/1984 |
| JP | 2003-79495 | | 3/2003 |
| JP | 2004-290531 | A | 10/2004 |
| JP | 2008-073174 | A | 4/2008 |
| JP | 2013-172802 | | 9/2013 |
| KR | 2003-0017261 | A | 3/2003 |
| KR | 30-0330692 | | 8/2003 |
| KR | 30-0507873 | | 10/2008 |
| KR | 30-0586341 | | 1/2011 |
| KR | 30-0692452 | | 5/2013 |
| KR | 30-0712086 | | 10/2013 |
| WO | WO 2013/047784 | A1 | 4/2013 |
| WO | WO 2018/045649 | A1 | 3/2018 |

OTHER PUBLICATIONS

Extended Search Report in corresponding European Patent Application No. 19157138.9, dated Jun. 14, 2019, in 8 pages.

U.S. Appl. No. 29/723,452, filed Feb. 6, 2020, Yang et al.

Zadro Z'fogless Mirror with Light, available from internet at http://www.amazon.com/Zadro-1X-Zfogless-Adjustable-Magnification/dp/B000ARWLIW/ref=sr_1 _16?s=beauty&ie-UTF8&qid=1439229012&sr=1-16&keywords=zadro+lighted+fogless+mirror, apparently available Nov. 27, 2006, site visited Aug. 10, 2015.

Kore, "Building an intelligent voice controlled mirror," retrieved from the internet on Jul. 11, 2019: https://medium.com/@akshaykore/building-an-intelligent-voice-controlled-mirror-2edbc7d62c9e, Jun. 26, 2017, in 10 pages.

U.S. Appl. No. 15/073,990, filed Mar. 18, 2016, Yang et al.

U.S. Appl. No. 29/631,301, filed Dec. 28, 2017, Yang et al.

U.S. Appl. No. 29/662,730, filed Sep. 7, 2018, Yang et al.

Advanced Lighting Guidelines, 1993 (second edition), Chapter entitled, "Occupant Sensors", Published by California Energy Commission (CEC Pub.), in 14 pages.

Brookstone Shower Mirror, available from internet at http://www.brookstone.com/9-Lighted-Fogless-Shower-Mirror?bkiid=?SubCategory_Bath_Spa_Mirrors_Lighting_Makeup_Mirrors%7CSubCategoryWidget%7C608364p&catId=n/, apparently available Jan. 15, 2013, site visited Dec. 2, 2014.

Jerdon Wall Mounted Mirror, available from internet at http://www.amazon.com/Jerdon-HL1016NL-9-5-Inch-Lighted-Magnification/dp/B00413G9K2/ref=sr_1_26?ie-UTF8&qid=1420579897&sr=8-26&keywords=wall+mounted+mirror#customerReviews, apparently available Feb. 21, 2009, site visited Jan. 8, 2015.

Jerdon Wall Mounted Mirror, available from internet at http://www.amazon.com/Jerdon-JD7C-9-Inch-Lighted-Magnification/dp/B001DKVC08/ref=sr_1_54?ie-UTF8&qid=1420580127&sr=8-54&keywords=wall+mounted+mirror, apparently available Oct. 6, 2010, site visited Jan. 8, 2015.

Simple Human Sensor Mirror, Internet Archive Wayback Machine webpage capture of http://www.tuvie.com/stainless-steel-sensor-mirror-by-simplehuman/, apparently available Jan. 27, 2013, site visited Dec. 2, 2014.

Simple Human Vanity Mirror, available from internet at http://www.bedbathandbeyond.com/store/products/ simplehuman-reg-5x-sensor-vanity-mirror/1041483503?categoryId=12028, apparently available Dec. 19, 2013, site visited Dec. 2, 2014.

Simplehuman Mini Sensor Mirror, available from internet at http://www.amazon.com/gp/product/B00FZ3MFAA/ref=pd_lpo_sbs_dp_ss_2?pf_rd_p=1944579862&pf_rd_s=lpo-top-stripe-1&pf_rd_t=201&pf_rd_i=B00M8MC5H4&pf_rd_m-ATVPDKIKXODER&pf_rd_r=0RHFJEABM9QKSWJKK99N#Ask, apparently available Mar. 11, 2014, site visited Jan. 8, 2015.

Simplehuman Sensor Mirror Pro Wide-View, available from internet at http://www.simplehuman.com/wide-view-sensor-mirror, site visited Aug. 9, 2016.

Simplehuman Sensor Mirror, available from internet at http://www.amazon.com/simplehuman-Sensor-Sensor-Activated-Lighted-Magnification/dp/B00M8MC5H4#customerReviews, apparently available Dec. 31, 2014, site visited Jan. 8, 2015.

Simplehuman Wall Mount Mirror, available from internet at http://www.amazon.com/simplehuman-Wall-Mount-Sensor-Mirror/dp/B00FN92ELG#customerReviews, available at least as early as Jan. 31, 2013, site visited Jan. 8, 2015.

(56) References Cited

OTHER PUBLICATIONS

Simplehuman Wide View Sensor Mirror, available from internet at http://www.amazon.com/simplehuman-Wide-View-Sensor-Mirror/dp/B01C2RXD7K, site visited Aug. 9, 2016.

* cited by examiner

COMPACT MIRROR

RELATED APPLICATIONS

This application claims the priority benefit under 35 U.S.C. § 119(e) of U.S. Provisional Patent Application No. 62/630,788, filed on Feb. 14, 2018, and U.S. Provisional Patent Application No. 62/640,147, filed on Mar. 8, 2018, both of which are entitled "Compact Mirror," and both of which are incorporated by reference herein for all that they disclose.

BACKGROUND

Field

The present disclosure relates generally to reflective devices, such as mirrors, and more specifically to illuminated reflective devices.

Description of the Related Art

Compact mirrors are mirrors that are typically used for reflecting an image of a user during personal grooming, primping, cosmetic care, or the like. Providing an illuminated mirror helps a user to more clearly see his or her reflection in the mirror.

SUMMARY

In some embodiments, a mirror system comprises a protective portion such as a holder or cover, and a mirror assembly configured to be at least partially received by or in contact with the protective portion in a first stage. In some embodiments, the mirror assembly comprises a housing portion, a mirror, an orienting structure, a light source, a light conveying channel, and an actuator such as a switch. For example, the actuator can be a switch that is configured to automatically activate or deactivate when two components in the mirror system interact or cease interacting (e.g., a reed switch). In some embodiments, the actuator can be configured to activate or deactivate one or more electronic components, such as the light source, when the mirror assembly is moved with respect to the protective portion between first and second positions, such as when the mirror assembly is at least partially separated from or placed in contact or in proximity with the protective portion. In some embodiments, the actuator can be configured to activate or deactivate the light source when in a second stage there is relative movement between at least a portion of the mirror assembly and at least a portion of the protective portion.

Any of the compact mirror features, structures, steps, or processes disclosed in this specification can be included in any embodiment. The protective portion can be a holder. The protective portion can be a cover. The cover can include a first panel, a second panel, and a fold line between the first and second panel. The mirror assembly can include a securing portion configured to engage a receiving portion. The protective portion can include a securing portion and/or a receiving portion. The securing portion can be a structure configured to be easily manipulated and/or actuated by a user to help selectively secure the protective portion to the mirror, such as snap fastener, a zipper, a magnetic arrangement (e.g., a pair of magnets, or a magnetic and a metal component), or any other suitable structure.

Certain aspects of this disclosure are directed toward a mirror assembly including a mirror and an orienting structure coupled with a housing portion and a light conveying channel.

The orienting structure can have a stored position and at least one deployed position. The orienting structure can be stored in a recessed portion of the housing portion. The orienting structure can be a finger-retaining ring and/or a stand.

In some embodiments, the mirror assembly includes a light path. The light path can be a light pipe disposed along substantially all of the periphery of the mirror. The light path can comprise a first end and a second end and the light source can emit light into the first end and another light source can emit light into the second end. Any type or configuration of light source(s) or light path(s) can be used to emit light from the mirror assembly toward the user to be reflected by the user toward the mirror to help illuminate an image of the user formed by the mirror. The mirror assembly can include a light scattering region disposed along the length of the light path. The mirror assembly can be configured to emit a substantially constant amount of light along the length of the light path.

The mirror assembly can include a rechargeable power source. The mirror assembly can include a proximity sensor configured to detect an object within a sensing region. The mirror assembly can include an electronic processor configured to generate an electronic signal to the one or more light sources for emitting a level of light that varies depending on the distance between the object and the sensor. The proximity sensor can be configured to have increased sensitivity after the proximity sensor detects the object.

Certain aspects of this disclosure are directed toward a method of using a mirror system. The method can include removing at least a portion of a mirror assembly from at least a portion of a holder, the mirror assembly turning on upon at least partial removal from the holder. The method can include viewing a reflection. The method can include returning at least a portion of the mirror assembly to at least a portion of the holder, the mirror assembly turning off upon being at least partially received by the holder.

For purposes of summarizing the disclosure, certain aspects, advantages and features have been described herein. It is to be understood that not necessarily any or all such advantages are achieved in accordance with any particular embodiment of the inventions disclosed herein. No aspects of this disclosure are essential or indispensable.

BRIEF DESCRIPTION OF THE DRAWINGS

The features of the mirror systems and assemblies disclosed herein are described below with reference to the drawings of certain embodiments. The illustrated embodiments are intended to demonstrate, but not to limit, the present disclosure. The proportions and relative dimensions and sizes of each component as shown in these drawings form part of the supporting disclosure of this specification, but should not be limiting on the scope of this specification, except to the extent that such proportions, dimensions, or sizes are included in any individual claims. The drawings contain the following Figures:

DETAILED DESCRIPTION OF CERTAIN EMBODIMENTS

Certain embodiments of a mirror assembly are disclosed in the context of a portable, compact mirror, as it has particular utility in this context. However, various aspects of the present disclosure can be used in many other contexts as well, such as free-standing vanity mirrors, wall-mounted mirrors, mirrors mounted on articles of furniture, automobile vanity mirrors (e.g., mirrors located in sun-visors), and otherwise. None of the features described herein are essential or indispensable. Any feature, structure, or step disclosed herein can be replaced with or combined with any other feature, structure, or step disclosed herein, or omitted.

Figure 1A:
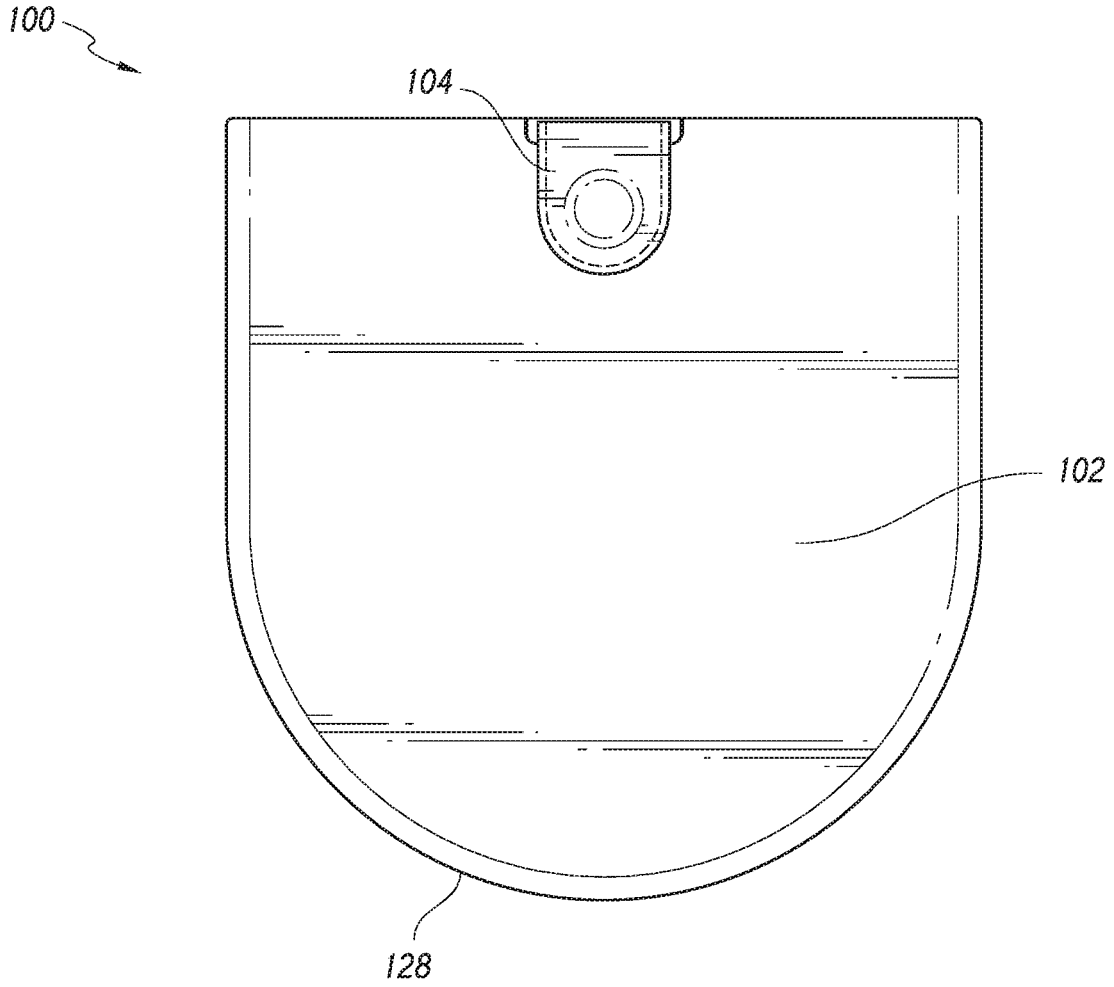
FIGS. 1A-1C illustrate front views of an embodiment of a mirror system in three different configurations.
Figure 1B:
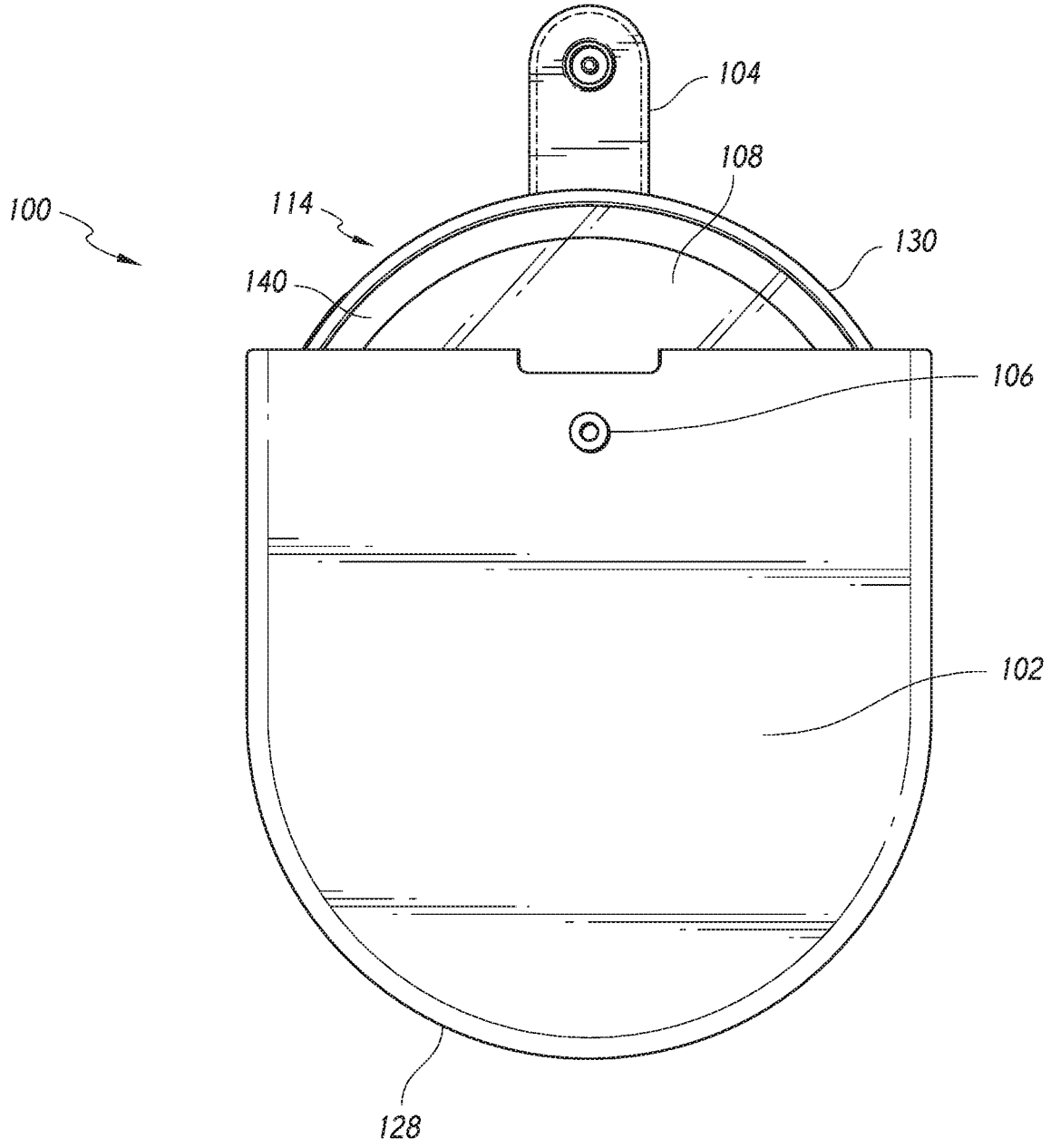
Figure 1C:
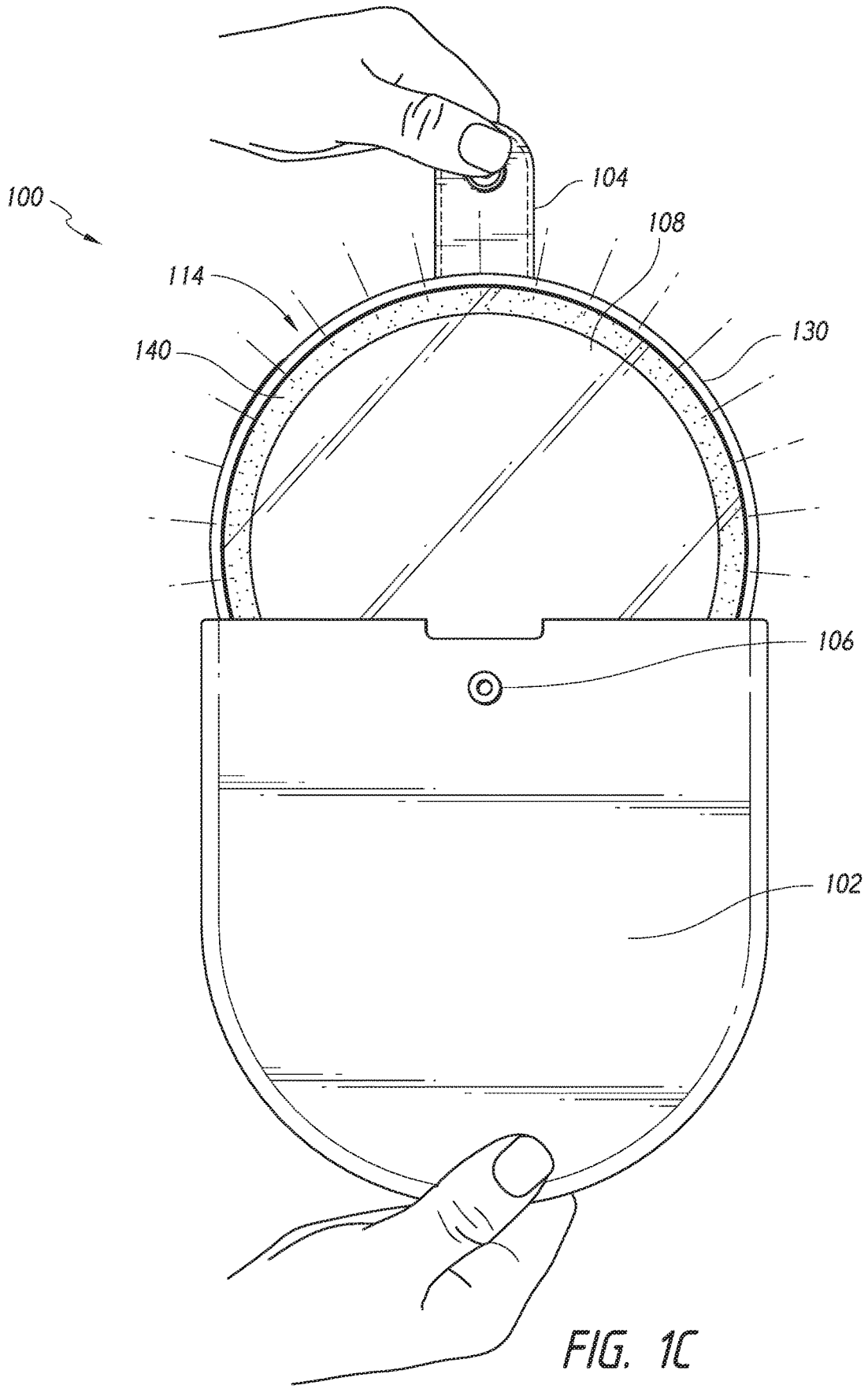
Figure 2:
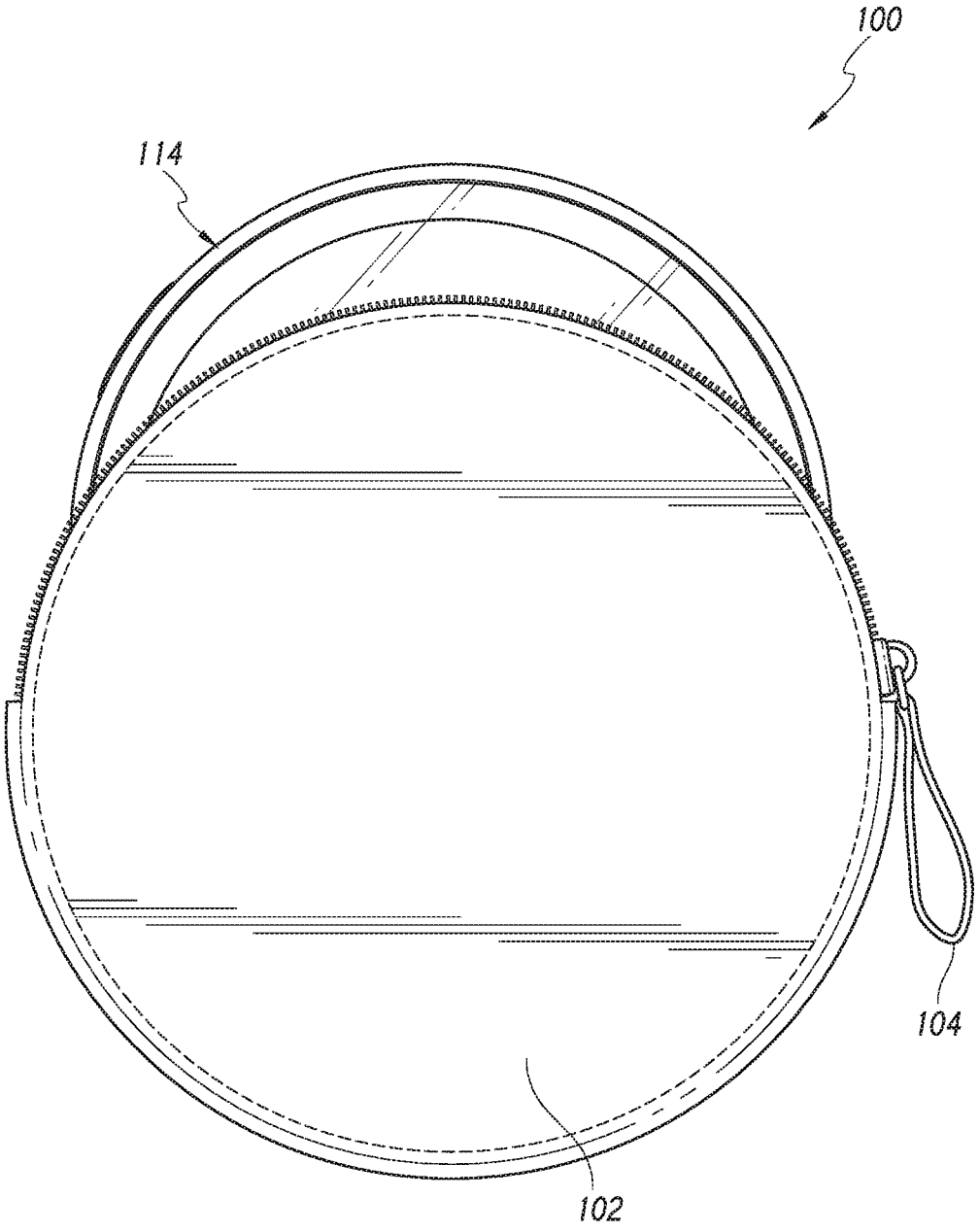
FIG. 2 illustrates a front view of another embodiment of the mirror system.
Figure 3:
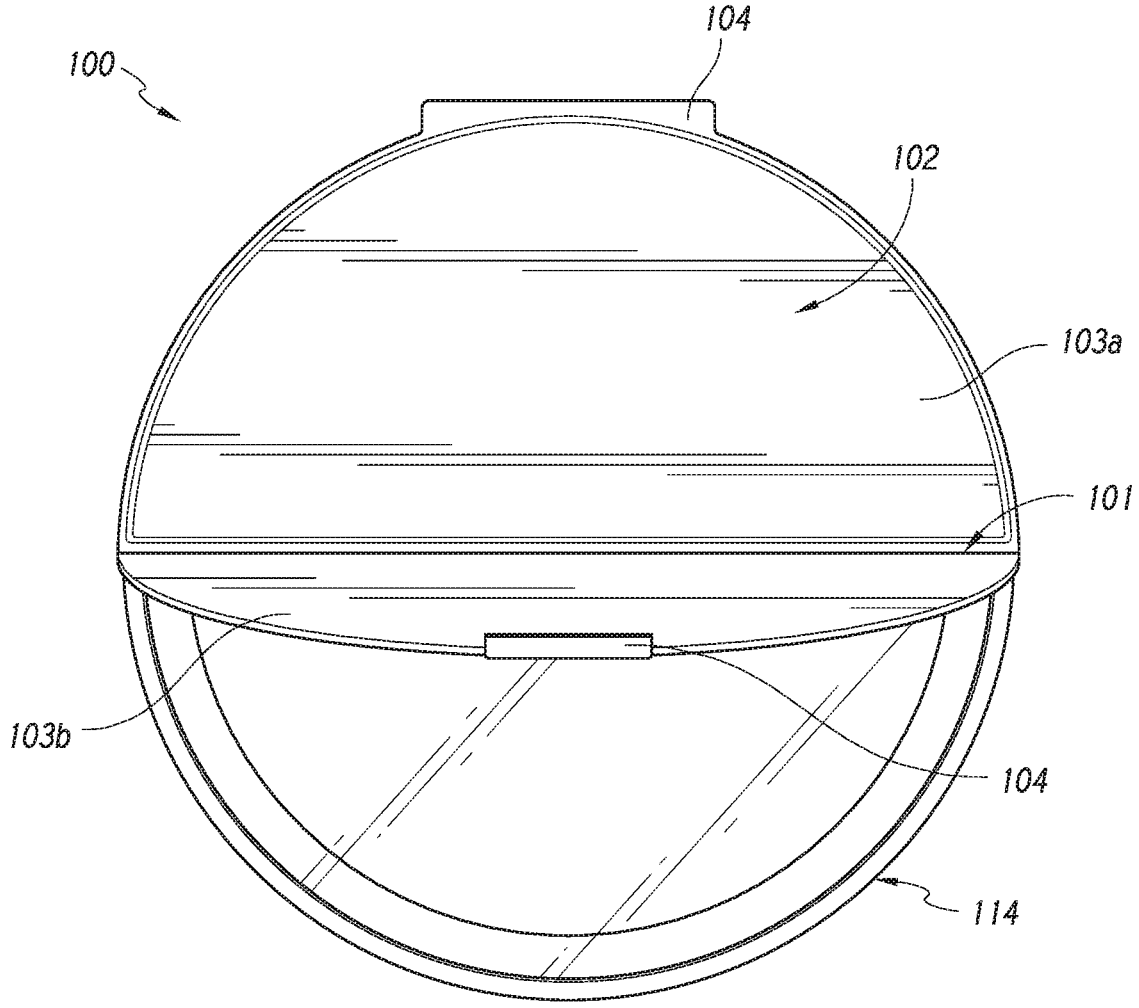
FIG. 3 illustrates a front view of another embodiment of the mirror system.

As shown in FIGS. 1A-3, in some embodiments the mirror system 100 can include a mirror assembly 114 with a mirror 108, and a protective portion 102 such as a holder or cover. The protective portion 102 can be configured to resist damage to or malfunction of the mirror assembly 114 and/or undue wear or accumulation of dirt, dust, or fingerprints on the mirror assembly 114, such as by covering, shielding, cushioning, and/or buffering the entire mirror assembly 114 or one or more portions of the mirror assembly 114 during storage or transportation or otherwise. The protective portion 102 can resist breaking, scratching, cracking, or chipping of the mirror assembly 114 or a portion thereof and/or can provide a barrier against dirt, dust, or direct handling by fingers on the mirror assembly 114, especially on the reflective mirror 108 itself. In some embodiments, at least a portion of the mirror assembly 114 can be received in or coupled with at least a portion of the protective portion 102. In some embodiments, the mirror assembly 114 can be enclosed in the holder 102 such that the mirror assembly 114 is positioned completely inside of the holder 102. For example, the mirror assembly 114 can be enclosed by a protective portion or holder 102 in the form of a pouch, sleeve, bag, case, box, capsule, or any structure on both of its front and rear sides. In some embodiments, the mirror assembly 114 can be covered (without being entirely enclosed by) a protective portion or cover 102 on at least one of its front and rear sides. In some embodiments, an enclosure or cover can include a zipping portion (e.g., as illustrated in FIG. 2), a snap fastener (e.g., as illustrated in FIG. 1A), a magnet (e.g., as illustrated in FIG. 3), a clasp, or other suitable structure attached to the mirror assembly 114 and/or the protective portion 102. In some embodiments, as shown, the protective portion 102 can provide one or more solid surfaces on its front and/or rear surfaces, without any openings or without any openings of sufficient size to permit damaging or otherwise impairing contact with the mirror 108.

In some embodiments, as illustrated in FIG. 3, the cover 102 can comprise a first panel 103*a* and a second panel 103*b*. The cover 102 can include a fold line 101. The fold line 101 can be disposed between, and separate, the first panel 103*a* and the second panel 103*b*. As discussed further below, in some embodiments, the first panel 103*a*, the second panel 103*b*, and the fold line 101 can be configured such that the cover 102 can be used as a stand to orient the mirror assembly 114 when placed on a surface, such as a table. For example, in some embodiments, the first and/or second panel 103*a*, 103*b* can be pivotable about the fold line 101.

The protective portion 102 can be circular, rectangular, square, or other suitable shapes. The protective portion 102 can be soft and/or rigid. The material(s) of which the protective portion 102 is made can include cloth, leather, rubber, silicone, plastic, and/or any other suitable materials.

In some embodiments, the protective portion or cover 102 is integral with and/or fixed to a portion of the mirror assembly 114. In some embodiments, as shown, the protective portion or holder 102 is not integral with and/or is not formed of the same material as the housing portion 116 or one or more other portions of the mirror assembly 114. The protective portion or holder 102 can be separated completely from the mirror assembly by a user during normal use without tools. In some embodiments, by providing a separable protective portion and housing portion 116, a user can conveniently use the mirror assembly 114 without the additional bulk and weight of the protective portion. The protective portion 102 can protect the mirror assembly 114 during storage and transportation, but not interfere during use. As illustrated, the protective portion 102 in some embodiments can be thin and light when the mirror assembly 114 is separated from the protective portion. For example, the overall thickness of the protective portion 102 by itself can be less than or equal to about the thickness of the mirror 108 by itself and/or the mirror assembly 114 by itself, and/or the thickness of the protective portion by itself can be less than or equal to about ¼ inch. In some embodiments, as shown, the protective portion 102 does not include any pocket or storage chamber for storing or carrying anything besides the mirror assembly 114, which also reduces the bulk and weight of the protective portion and the overall mirror system 100.

As illustrated in FIGS. 1A-1B, in some embodiments the mirror system 100 can comprise a securing portion 104 configured to engage a receiving portion 106. In some embodiments, the securing portion 104 is positioned on the mirror assembly 114 and the receiving portion 106 is positioned on the holder 102, or the securing portion 104 is positioned on the holder 102 and the receiving portion 106 is positioned on the mirror assembly 114. For example, the securing portion 104 can be permanently or removably attached to the mirror assembly 114. In some embodiments, as shown the securing portion 104 can also be a grasping portion to help the user remove the mirror assembly 114 from the holder 102 without requiring the user to contact the periphery of the mirror assembly 114 (which may be difficult in situations, as shown, where there is a tight or snug fit between the inside of the holder 102 and the outside of the mirror assembly 114) or the mirror 108 itself (which could cause fingerprints or scratching). As illustrated, the grasping and/or securing portion can be made of a different material than the housing or periphery of the mirror assembly 114. For example, the grasping and/or securing portion can be made of a flexible material, such as cloth, leather, silicone, string, cord, etc., and the housing or periphery of the mirror assembly 114 can be made of a rigid material, such as metal, plastic, etc. In some embodiments, a securing portion does not function as a grasping portion, and/or a separate securing portion and a grasping portion can be provided. As illustrated, in some embodiments of a structure that provides both functions, the securing portion 104 can include a tab that is accessible to the user for pulling the mirror assembly 114 out of the holder 102. In some embodiments, the securing portion 104 and the receiving portion 106 can both be positioned on the holder 102 or on the mirror assembly 114. For example, the securing portion 104 can be positioned on, or be coupled to, the back of the holder 102 and extend across the top of the holder 102 to the front of the holder 102, where it can engage the receiving portion 106.

Figure 6:
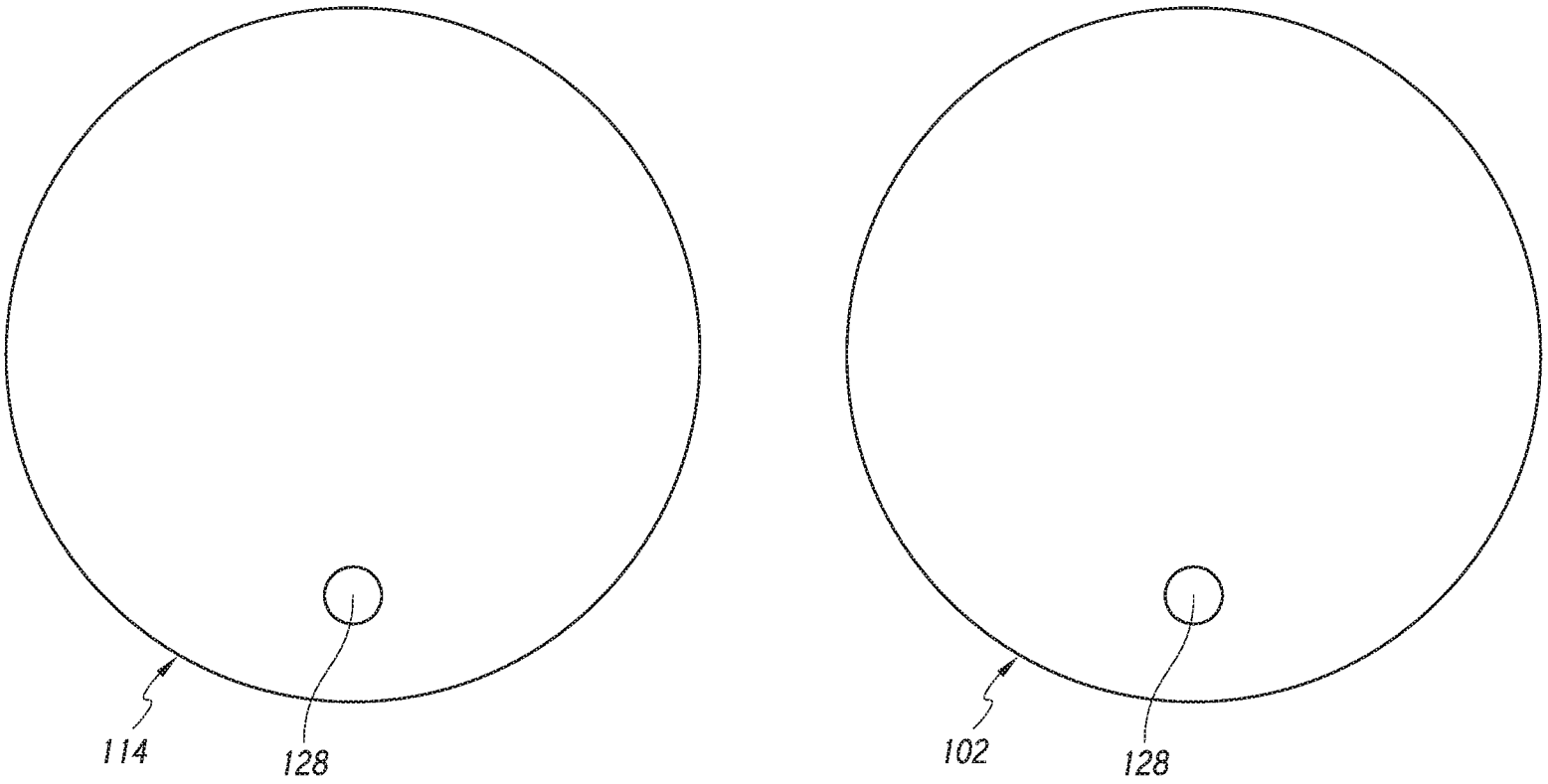
Figure 9A:
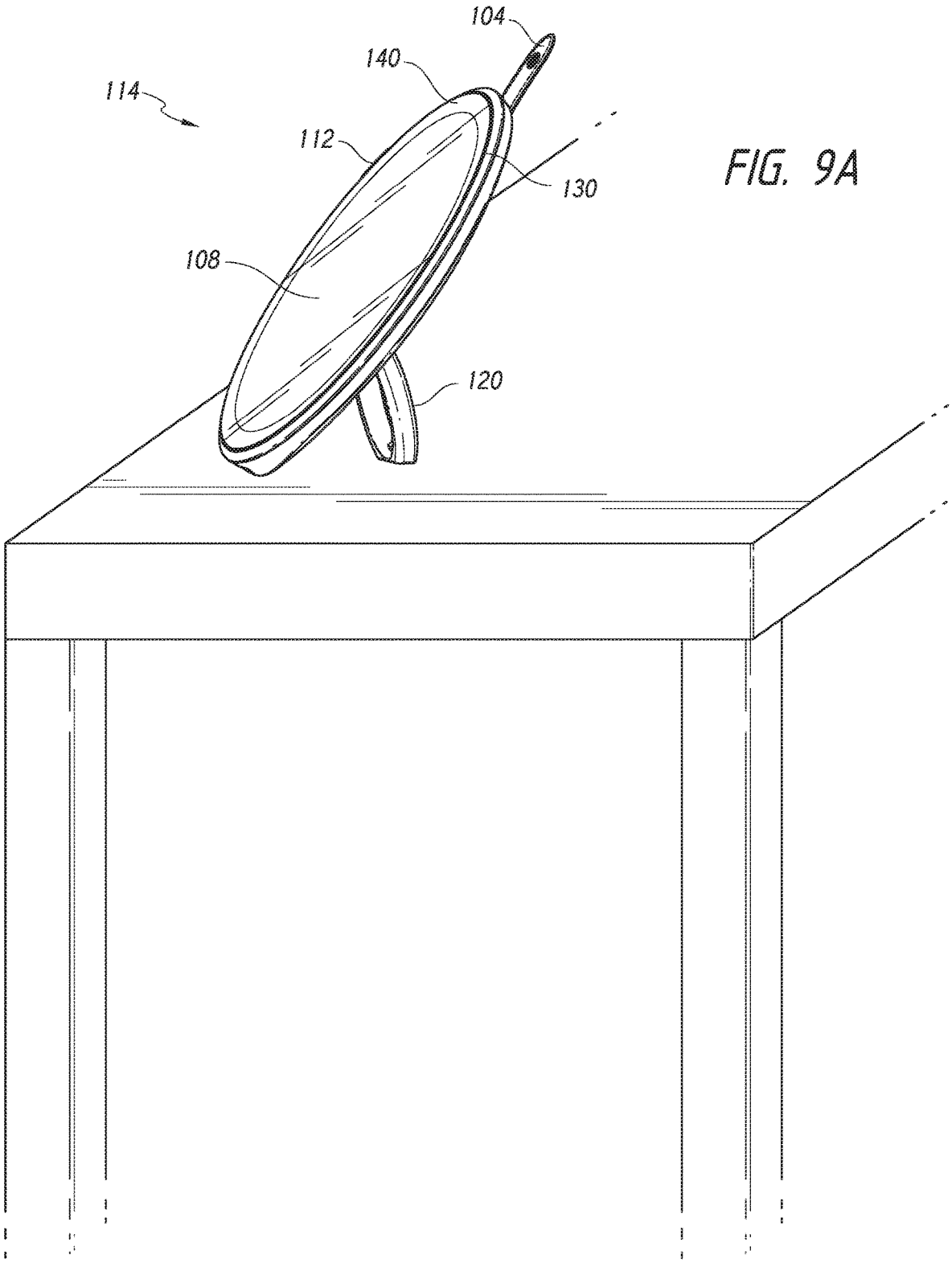
FIG. 9A illustrates a front perspective view of the embodiment of FIG. 7 in a deployed configuration of the orienting structure.
Figure 9B:
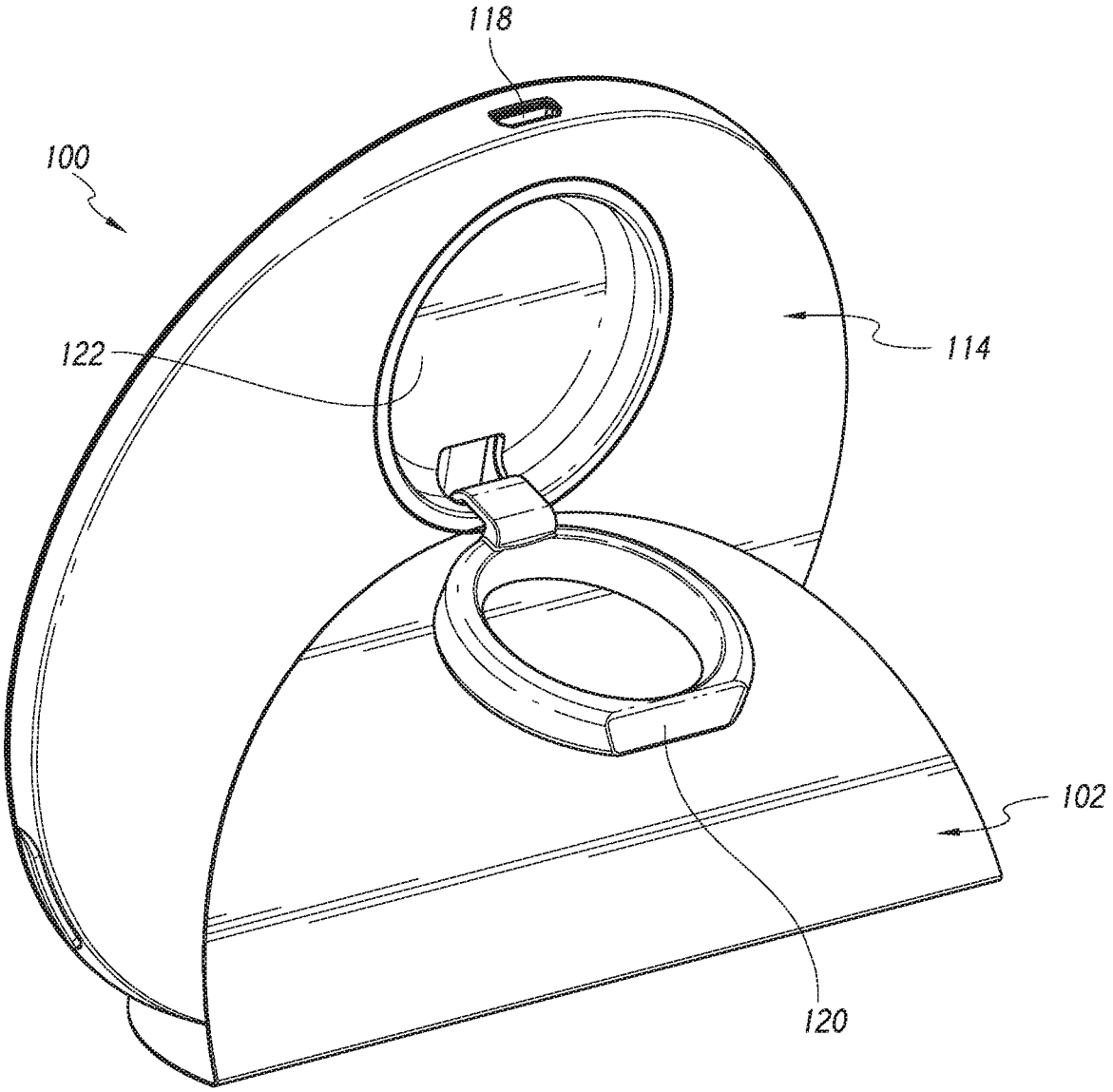
FIG. 9B illustrates a rear perspective view of the embodiment of FIG. 3 in a deployed configuration of the protective portion.

In some embodiments, as illustrated in FIGS. 1A-3, the mirror system 100 can include at least one securing portion 104. The securing portion 104 can be permanently or removably attached to the protective portion 102 and/or the mirror assembly 114. The securing portion 104 can include any suitable structure for easily helping to secure the protective portion 102 to the mirror assembly 114, such as a zipper, a snap fastener, a magnet, a clasp, or other suitable structure. The securing portion 104 can be positioned entirely on the protective portion 102, entirely on the mirror assembly, and/or can interact with a portion of the protective portion 102 or mirror assembly 114. For example, as illustrated in FIG. 2, the securing portion 104 can comprise a zipper disposed along a portion of the periphery of the protective portion or holder 102. The zipper can be positioned along a top periphery, bottom periphery, and/or side periphery of the protective portion or holder 102. As shown in FIG. 3, in some embodiments, the securing portion 104 can attach the cover 102 to the mirror assembly 114 on at least one end of the mirror assembly 114. The securing portion 104 can be a pivoting member with an axis of rotation or fold, such as a hinge or tether. For example, as illustrated in FIGS. 3 and 9B, the securing portion 104 can fix the cover 102 to the mirror assembly 114 at a location on the mirror assembly 114 and enable the cover 102 to rotate about the securing portion's 104 axis of rotation. In some embodiments, the securing portion 104 can be a magnetic closure. For example, as illustrated in FIGS. 3 and 6, the cover 102 can include a securing portion 104 comprising a first magnet 128 configured to engage a second magnet 128 in the mirror assembly 114. The magnet 128 in the cover 102 and the magnet 128 in the mirror assembly 114 can be oriented with opposite polarities in proximity during closure or securement to induce an attractive attachment force. The magnets 128 can be positioned near a periphery of the mirror assembly 114 and/or cover 102, or spaced apart from the peripheries.

In some embodiments, as illustrated in FIG. 3, the mirror system 100 can include more than one securing portion 104. For example, the protective portion or cover 102 can be fixed to the mirror assembly 114 by a first securing portion 104 at a first end of the cover 102 and selectively attached to the mirror assembly 114 by a second securing portion 104 at an opposite end of the cover 102.

In some embodiments, the contact and/or lack of contact of the mirror assembly 114 and the protective portion 102 can trigger one or more functions. For example, as shown in FIG. 1C, removing at least a portion of the mirror assembly 114 from the holder 102 can cause the mirror assembly 114 to turn on, or illuminate. In some embodiments, lifting the protective portion or cover 102 or a portion of the protective portion or cover 102 away from the mirror assembly 114 can cause the mirror assembly 114 to turn on, or illuminate. Placing at least a portion of an illuminated mirror assembly 114 into, above, and/or beneath the protective portion 102 can cause the illuminated mirror assembly 114 to turn off. In some embodiments, the mirror assembly 114 comprises a component interaction actuator, such as a switch, configured to automatically activate or deactivate when two components in the mirror system 100 interact or cease interacting. For example, the mirror assembly 114 can include a reed switch, a contact switch, a toggle switch, a piezoelectric switch, a pressure switch, a proximity sensor, an electrical circuit completer, or any other suitable switch or sensor. In some embodiments, the protective portion 102 includes a component configured to interact with a switch in the mirror assembly 114. For example, the protective portion (e.g., holder or cover) 102 can include at least one magnet 128. The magnet(s) 128 can be located anywhere on the interior or exterior of the protective portion 102 (e.g., the magnet(s) 128 can be positioned near or adjacent the top, center, sides, and/or bottom of the protective portion 102). In some embodiments, the mirror assembly 114 can include at least one sensor 124. For example, the sensor(s) 124 can be located anywhere on the interior or exterior of the mirror assembly 114 (e.g., the sensor(s) 124 can be positioned near or adjacent the top, center, sides, and/or bottom of the mirror assembly 114).

Figure 4:
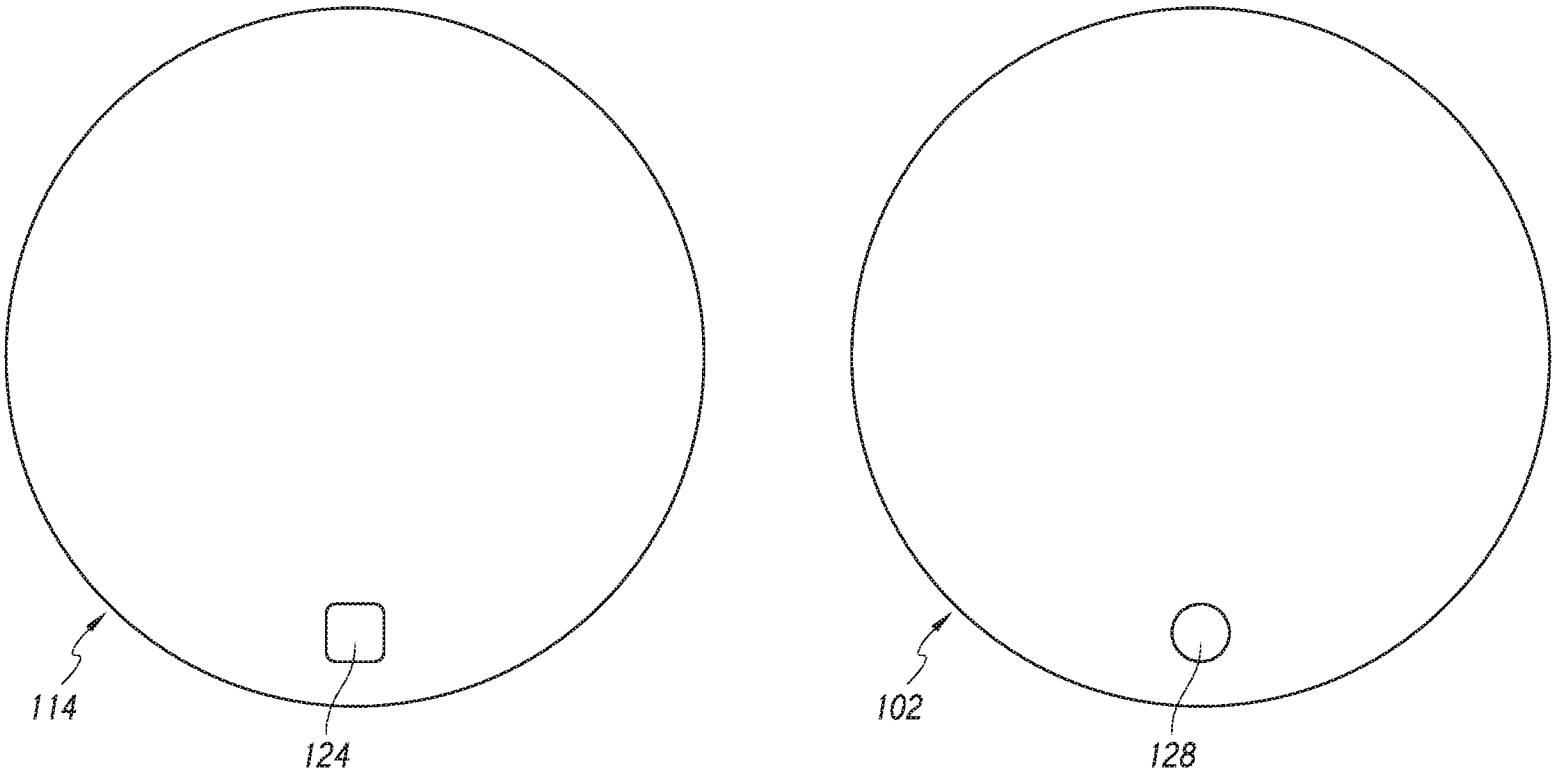
FIGS. 4-6 are schematic views of embodiments of the mirror assembly and protective portion.
Figure 5:
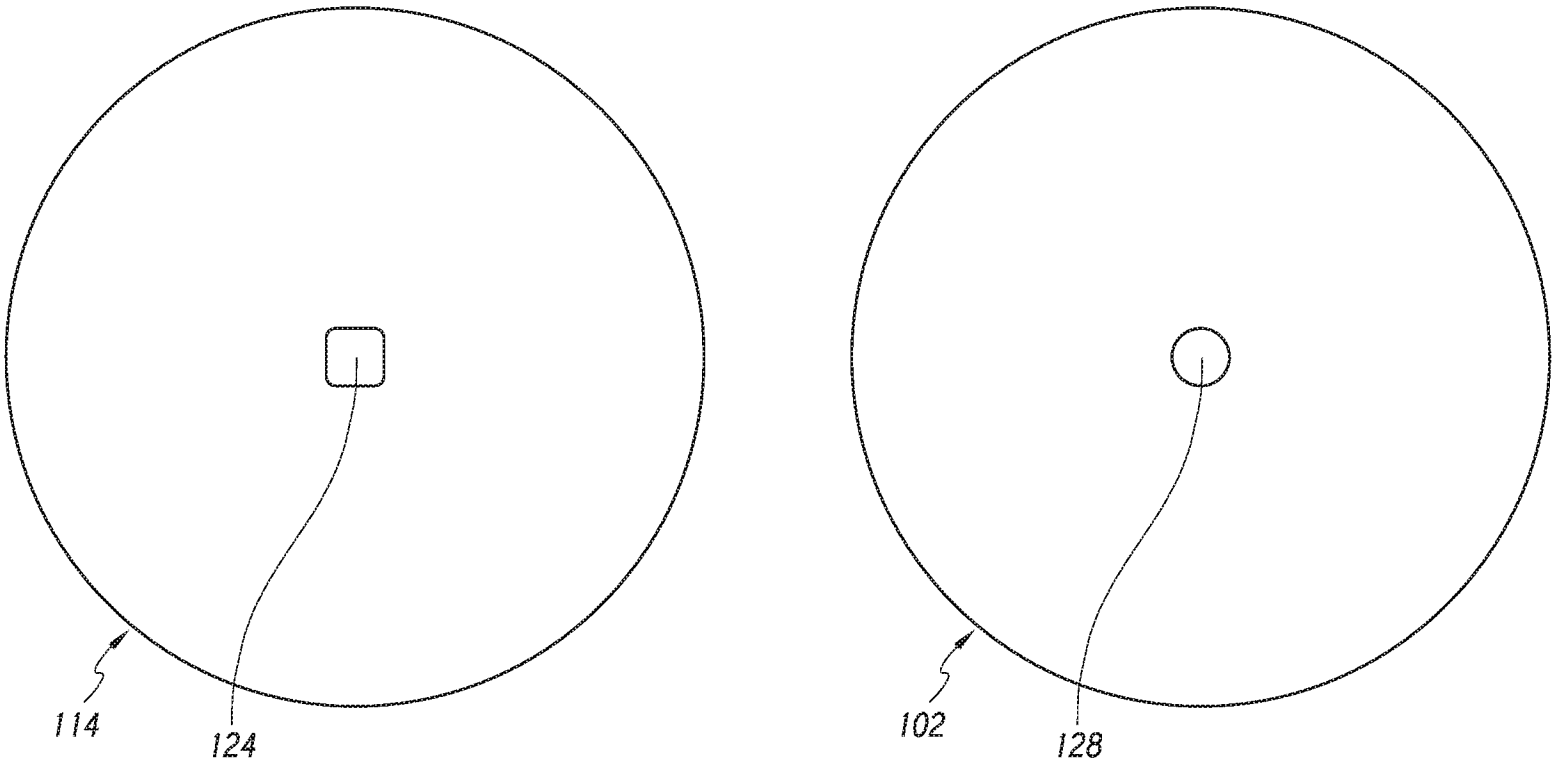

In some embodiments, as illustrated in FIGS. 4-5, the mirror assembly 114 includes a sensor 124 such as a reed switch and the protective portion 102 includes a magnet 128. As illustrated in FIG. 4, in some embodiments, the sensor 124 and the magnet 128 can be disposed adjacent the circumference or periphery of the mirror assembly 114 and protective portion 102, respectively. In some embodiments, the sensor 124 and magnet 128 can be spaced away from the circumference or periphery of the mirror assembly 114 and protective portion 102, respectively. As illustrated in FIG. 5, in some embodiments, the sensor 124 and magnet 128 can be disposed at or near the center of the mirror assembly 114 and protective portion 102, respectively. In some embodiments, the sensor 124 and magnet 128 can be spaced away from the center of the mirror assembly 114 and protective portion 102, respectively. In some embodiments, the mirror system 100 can include a first sensor 124 and a first magnet 128 disposed adjacent the periphery of the mirror assembly 114 and protective portion 102, respectively, and a second sensor 124 and a second magnet 128 disposed at or near the center of the mirror assembly 114 and protective portion 102, respectively.

In some embodiments, the mirror assembly 114 includes an electronic circuit board 152 configured to communicate with, control, and/or operate the reed switch 124. The reed switch 124 can be configured to activate automatically upon removal of at least a portion of the mirror assembly 114 from contact or interaction with the protective portion 102 and to automatically deactivate upon returning at least a portion of the mirror assembly 114 to the protective portion 102. The presence of a magnetic field near the reed switch 124 can be configured to stop the current of the reed switch 124. Removal of at least a portion of the mirror assembly 114 from the holder 102, or movement of at least a portion of the mirror assembly 114 with respect to the holder 102, can increase the distance between the source of the magnetic field and the reed switch 124, enabling the current to flow and the mirror assembly 114 to turn on, or illuminate.

As shown in FIGS. 7-9B, the mirror assembly 114 can include a housing portion 116, a visual image reflective surface, such as a mirror 108, and an orienting structure 120. Certain components of the housing portion 116 can be integrally formed or separately formed and connected together to form the housing portion 116. The materials of which the housing portion 116 is made can include plastic, metal (e.g., stainless steel, aluminum, etc.) or any other suitable materials.

As illustrated, in some embodiments, the outer profile of the housing portion 116 or the outer profile of the mirror assembly 114 can be small and compact so as to be easily portable, conveniently fitting within a backpack, purse, or luggage carry-on. As shown, the outer periphery or circumference of the housing portion 116 of the mirror assembly 114 can be approximately the same size as or just slightly larger than the outer periphery or circumference of the mirror 108 itself, such that the housing portion 116 does not add significant bulk or volume to the mirror assembly 114 much beyond the size of the mirror 108 itself. As illustrated, in some embodiments, the mirror assembly 114 does not include any stand or mount or support that permanently extends outwardly from the housing portion 116 of the mirror assembly 114, and/or the mirror assembly 114 does not include a permanently attached power cord, making the mirror assembly 114 substantially lighter and smaller and therefore easier and more convenient to store and transport than vanity mirrors with bulky supporting and power-supplying structures.

In some embodiments, the thickness of the housing portion 116 and/or the thickness of the overall mirror assembly 114 or mirror system 100 (e.g., the distance between the front surface with the mirror 108 to the rear surface) can be generally small, such as about the same size as or less than the length of the distalmost segment or phalange of a finger of a user in the target population for the mirror system 100. For example, for some target populations, the thickness of the housing portion 116 and/or the thickness of the overall mirror assembly 114 or mirror system 100 can be less than or equal to about 1 inch or less than or equal to about 0.75 inch. By providing a small thickness for the housing portion 116, mirror assembly 114, and/or mirror system 100, a user is enabled to hold the mirror assembly 114 in one hand during use while slightly flexing the fingers and contacting the mirror assembly 114 with the distalmost flanges of the user's fingers.

In some embodiments, as shown, the diameter or distance across the mirror assembly 114 is about the same size as or smaller than the maximum hand span (e.g., the distance between the tip of the thumb and the tip of the smallest finger when the fingers of the hand are fully extended) of an average person in the target population of users of the mirror assembly 114. For example, for some target populations, the diameter or distance across the mirror assembly 114 can be less than or equal to about 9 inches or less than or equal to about 8 inches. The mirror assembly 114 can be configured to be conveniently and securely grasped by an average user in one hand, freeing the user's other hand to perform additional tasks, such as applying make-up or combing hair or shaving. In some embodiments, the protective portion can have about the same diameter or distance across as the mirror assembly 114 so as to not add significant additional bulk or weight. In some embodiments, the protective portion is substantially larger in one or more dimensions than the mirror assembly 114.

In some embodiments, the orienting structure 120 is configured to hold, orient, support, or maintain a position of the mirror assembly 114 in a specific position or positions. In some embodiments, the orienting structure 120 can have multiple positions, such as a stored position and at least one deployed position. In some embodiments, the orienting structure 120 requires a larger force to initially actuate and/or move from the stored position to a deployed position than is required to move the orienting structure 120 farther after it has been initially actuated and/or moved from the stored position. For example, an initial force $F_1$ can be required to initially actuate and/or move the orienting structure 120 from its recess or stored position that is larger than a subsequent force $F_2$ required to move it farther. This can help prevent the orienting structure 120 from being actuated or moving outside of its recess unintentionally. In some embodiments, the one or more deployed positions can cause the orienting structure 120 to form an angle with another surface of the mirror assembly 114 (such as a back surface of the mirror assembly 114) that is equal to or less than about: 90°, about 60°, or about 20°, values between the aforementioned values, or otherwise. In some embodiments, the orienting structure 120 can be stored in a recessed portion 122 of the mirror assembly 114, such that the orienting structure 120 in the stored position is generally flush or generally even with the region of the mirror assembly 114 immediately surrounding or adjacent to the recessed portion 122 in a manner that does not add volume or bulk to the mirror assembly 114 beyond the housing portion 116 of the mirror assembly 114, or in or other suitable locations. The recessed portion 122 can be positioned on any portion of the housing portion 116. In some embodiments, the orienting structure 120 can be circular, rectangular, square, or other suitable shapes. In some embodiments, the orienting structure 120 can comprise plastic, rubber, metal (e.g. stainless steel, aluminum, etc.), composite, or other suitable materials.

In some embodiments, the orienting structure 120 can be actuated by the user to transition the orienting structure 120 from a stored position to a deployed position, from one deployed position to another deployed position, or from a deployed position to a stored position, such as by pivoting or turning or otherwise extending the orienting structure 120 from the stored position into the deployed position. In some embodiments, the orienting structure 120 can be coupled to the housing portion 116 using a pivoting support 144, such as a friction hinge, or other suitable structures. In some embodiments, the pivoting support 144 and orienting structure 120 are configured such that there are predetermined deployed positions and/or static locations. The orienting structure 120 can be more difficult (e.g., requiring a larger force) to move from a static location than it is to move between static locations (e.g., requiring a smaller force).

Figure 7:
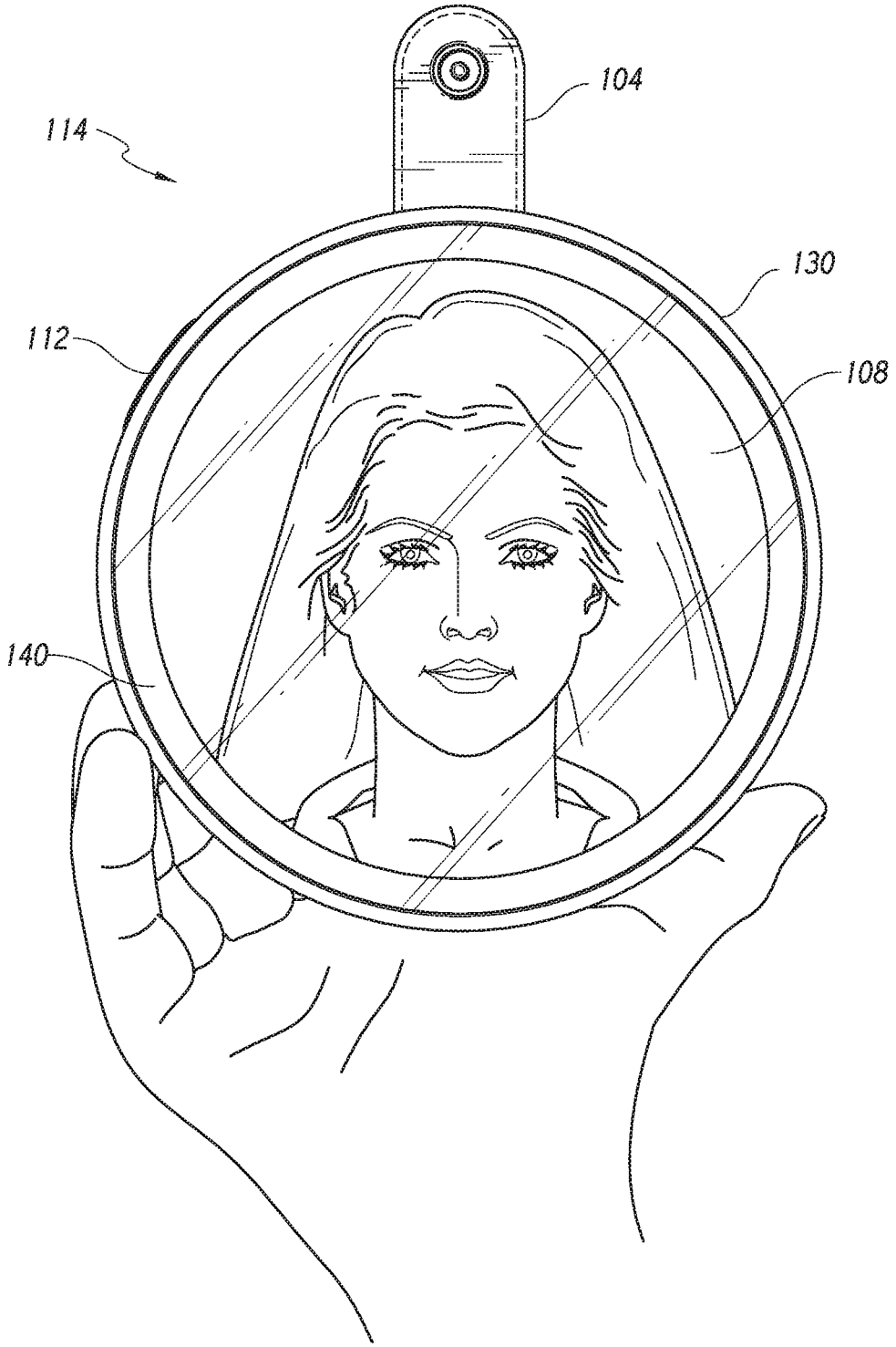
FIG. 7 illustrates a front view of a user holding an embodiment of a mirror assembly.

In some embodiments, when the orienting structure 120 is in a deployed position, the user can use the orienting structure 120 as a finger-retaining portion. As shown in FIG. 7, in some embodiments, the user can hold the mirror assembly 114 in at least one of his or her hands. For example, the user can hold the mirror assembly 114 in one or two hands. When the mirror assembly 114 is held by the user, the orienting structure 120 can be positioned in the stored position or a deployed position. As illustrated in FIG. 9A, in some embodiments, the mirror assembly 114 can be positioned generally upright in a convenient viewing position on a surface (e.g., a table, a desk, the ground, etc.) with the orienting structure 120 supporting it. For example, the orienting structure 120 can be used as a stand for the mirror assembly 114. In some embodiments, the orienting structure 120 can have deployed positions between about 0° and about 180°. The mirror assembly 114 can be positioned on a surface and angled to face the user using the orienting structure 120. In some embodiments, the orienting structure 120 is configured to engage a mount (e.g., on a mirror or wall). For example, the user can fix or hang the mirror assembly 114 to a wall in a bedroom or bathroom by attaching the orienting structure 120 to a portion on the wall.

In some embodiments, the protective portion or cover 102 can be used as a stand to orient the mirror assembly 114 when placed on a surface, such as a table. In some embodiments, the cover 102 includes a first panel 103*a*, a second panel 103*b*, and a fold line 101 between the first and second panels 103*a*, 103*b*. The first and/or second panels 103*a*, 103*b* can be pivotable about the fold line 101. The cover 102 can fold over the top and/or bottom of the mirror assembly 114. The first and second panels 103*a*, 103*b* can fold relative to one another along the fold line 101. In some embodiments, one of the first and second panels 103*a*, 103*b* is configured to be positioned flat on a surface and the other of the first and second panels 103*a*, 103*b* is placed in contact with the rear surface of the mirror assembly 114. In some embodiments, as illustrated in FIG. 9B, the first and/or second panel 103*a*, 103*b* can be secured in place by the orienting structure 120. For example, the orienting structure 120, in a deployed position, can be configured to apply pressure to the first and/or second panel 103*a*, 103*b* and the rear surface of the mirror assembly 114 with which the panel 103*a*, 103*b* is in contact, thereby holding the cover 102 in a particular position.

In some embodiments, as illustrated, the ring or annular member of the orienting structure 120 has an opening that has a circumference that is generally the same size as or slightly larger than the average circumference of an index or other finger of the target population of users of the mirror system 100, such that an average user can insert his or her finger into the opening of the annular member or ring to help securely hold the mirror system 100 in the user's hand. For example, in some embodiments, the circumference of the opening in the annular member or ring can be at least about 2.5 inches.

In some embodiments, as shown, the mirror system 100 or the mirror assembly 114 can include only a single mirror 108 or only a single side and/or a single portion with one or more mirrors on it to diminish the bulk and weight of the mirror system 100 or the mirror assembly 114. The mirror 108 can include a generally flat or generally spherical surface, which can be convex or concave. The radius of curvature can depend on the desired optical power. In some embodiments, the radius of curvature can be at least about 15 inches and/or less than or equal to about 32 inches. The focal length can be half of the radius of curvature. For example, the focal length can be at least about 7.5 inches and/or less than or equal to about 16 inches. In some embodiments, the radius of curvature can be at least about 18 inches and/or less than or equal to about 24 inches. In some embodiments, the mirror 108 can include a radius of curvature of about 20 inches and a focal length of about 10 inches. In some embodiments, the mirror 108 is aspherical, which can facilitate customization of the focal points.

In some embodiments, the radius of curvature of the mirror 108 is selected or controlled such that the magnification (optical power) of the object is at least about 2 times larger and/or less than or equal to about 15 times larger. In certain embodiments, the magnification of the object is about 5 times larger. In some embodiments, the mirror can have a radius of curvature of about 19 inches and/or about 7 times magnification. In some embodiments, the mirror can have a radius of curvature of about 24 inches and/or about 5 times magnification.

As shown in FIG. 9A, the mirror 108 can have a generally circular shape. In some embodiments, the mirror 108 can have an overall shape that is generally elliptical, generally square, generally rectangular, or any other shape. In some embodiments, the mirror 108 can have a diameter of at least about 2 inches and/or less than or equal to about 6 inches. In some embodiments, the mirror 108 can have a diameter of about 3 inches. In certain embodiments, the mirror 108 can have a diameter of at least about 4 inches and/or less than or equal to about 6 inches. In some embodiments, the mirror 108 can include a thickness of at least about 2 mm and/or less than or equal to about 3 mm. In some embodiments, the thickness is less than or equal to about 2 mm and/or greater than or equal to about 3 mm, depending on the desired properties of the mirror 108 (e.g., reduced weight or greater strength).

The mirror 108 can be highly reflective (e.g., at least about 90% reflectivity). In some embodiments, the mirror 108 has greater than about 70% reflectivity and/or less than or equal to about 90% reflectivity. In other embodiments, the mirror 108 has at least about 80% reflectivity and/or less than or equal to about 100% reflectivity. In certain embodiments, the mirror has about 87% reflectivity. The mirror 108 can be cut out or ground off from a larger mirror blank so that mirror edge distortions are diminished or eliminated. One or more filters can be provided on the mirror to adjust one or more parameters of the reflected light. In some embodiments, the filter comprises a film and/or a coating that absorbs or enhances the reflection of certain bandwidths of electromagnetic energy. In some embodiments, one or more color adjusting filters, such as a Makrolon filter, can be applied to the mirror to attenuate desired wavelengths of light in the visible spectrum.

The mirror 108 can be highly transmissive (e.g., nearly 100% transmission). In some embodiments, transmission can be at least about 90%. In some embodiments, transmission can be at least about 95%. In some embodiments, transmission can be at least about 99%. The mirror 108 can be optical grade and/or comprise glass. For example, the mirror 108 can include ultra clear glass. Alternatively, the mirror 108 can include other translucent materials, such as plastic, nylon, acrylic, or other suitable materials. The mirror 108 can also include a backing including aluminum or silver. In some embodiments, the backing can impart a slightly colored tone, such as a slightly bluish tone to the mirror. In some embodiments, an aluminum backing can prevent rust formation and provide an even color tone. The mirror 108 can be manufactured using molding, machining, grinding, polishing, or other techniques.

Figure 10A:
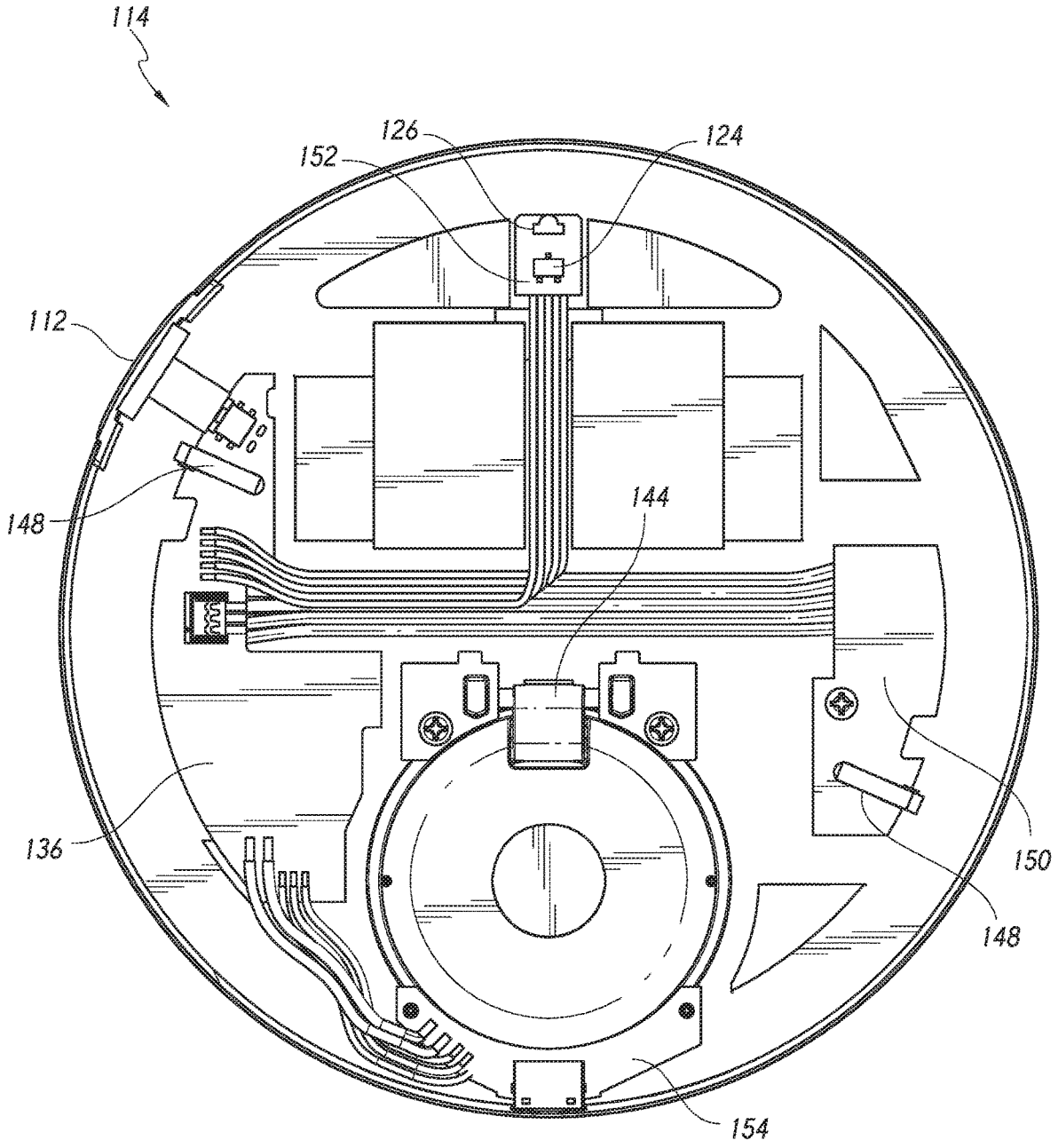
FIGS. 10A-10B illustrate front cross-sectional views of the embodiment of FIG. 7.
Figure 10B:
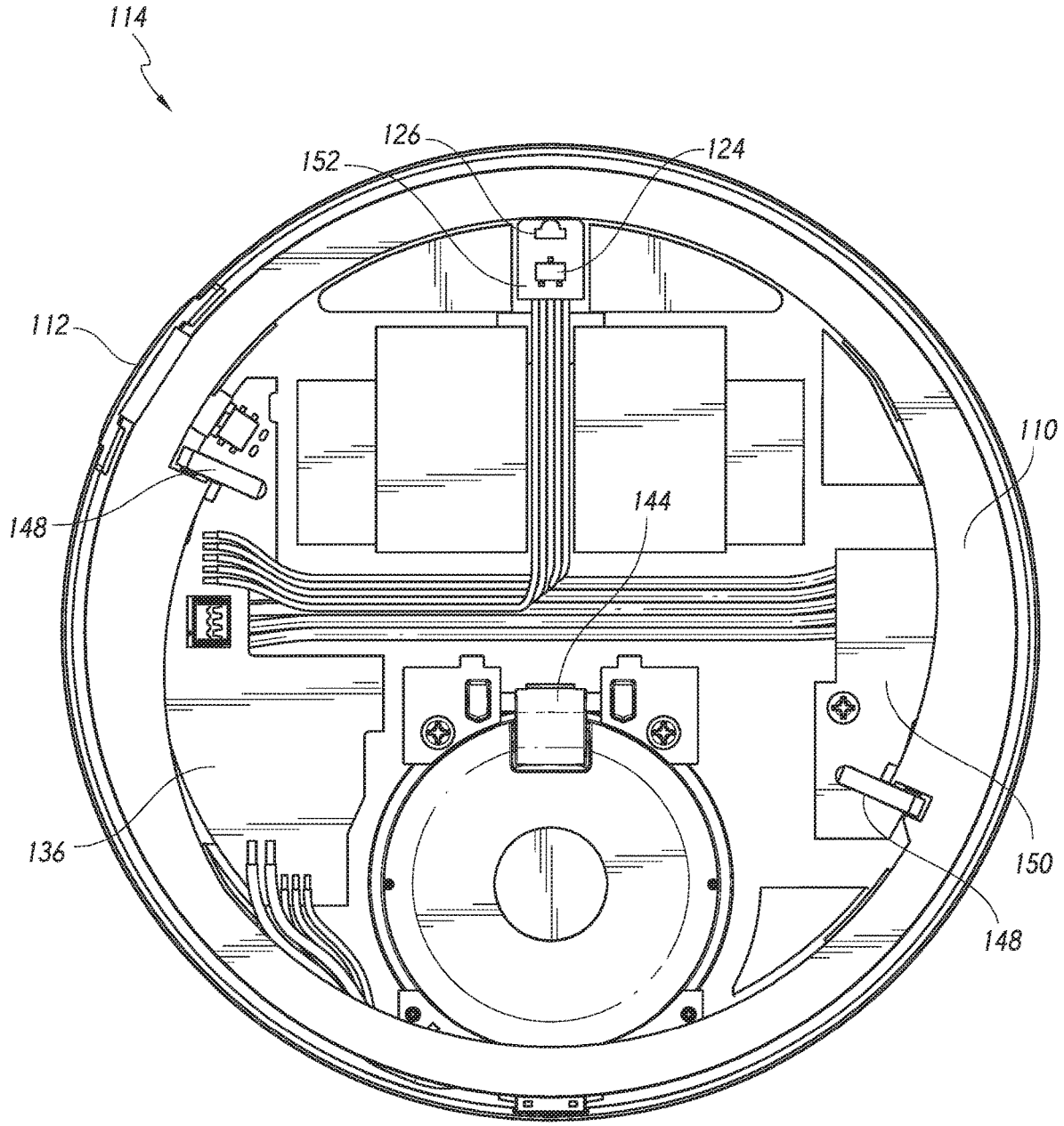
Figure 11:
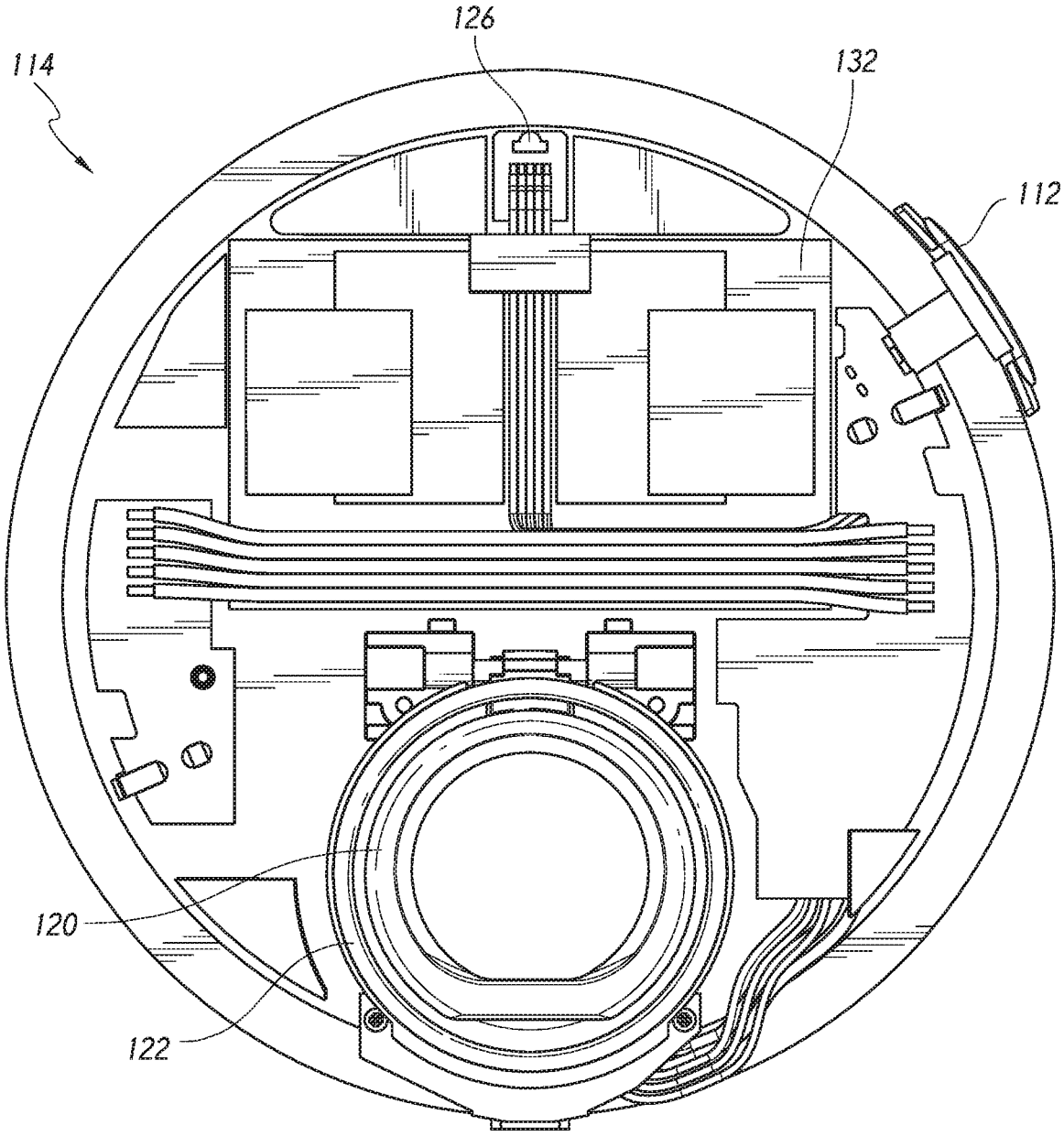
FIG. 11 illustrates a rear cross-sectional view of the embodiment of FIG. 7.

As shown in FIGS. 10A-10B, the mirror assembly 114 can include one or more light sources 126 configured to transmit light and a light source board 150 configured to operate or control the one or more light sources 126. For example, the mirror assembly can include a plurality (e.g., two) of light sources 126. Various light sources 126 can be used. For example, the light sources 126 can include light emitting diodes (LEDs), fluorescent light sources, incandescent light sources, halogen light sources, or otherwise. In some embodiments, each light source 126 consumes at least about 1 watt of power and/or less than or equal to about 3 watts of power. In certain embodiments, each light source 126 consumes about 2 watts of power.

In certain embodiments, the width of each light source 126 can be less than or equal to about 10.0 mm. In certain embodiments, the width of each light source 126 can be less than or equal to about 6.5 mm. In certain embodiments, the width of each light source 126 can be less than or equal to about 5.0 mm. In certain embodiments, the width of each light source 126 can be about 3.0 mm. In some embodiments, the mirror assembly 114 includes one or more light source end mounts 148. In some embodiments, the one or more light source end mounts 148 can include one or more heat sinks configured to transfer or dissipate heat generated by the one or more light sources by providing a larger surface area over which heat can be radiated into the air or into another component of the mirror assembly 114.

In some embodiments, either or both the color and the color temperature of the light emitted from the mirror 108 is independently adjustable. Using this adjustability, the light emitted from the light sources 126 can be configured to mimic or closely approximate light encountered in one or a plurality of different natural or non-natural light environments. For example, in some embodiments, the light emitted from the mirror 108 can mimic natural light (e.g., ambient light from the sun, moon, lightning, etc.). In certain implementations, lighting conditions that match (or closely approximate) restaurants (e.g., incandescent lights, candlelight, etc.), offices (e.g., fluorescent lights, incandescent lights, and combinations thereof), outdoor venues at different times of day (dawn, morning, noon, afternoon, sunset, dusk, etc.), outdoor venues at different seasons (spring, summer, fall, winter), outdoor venues having different weather conditions (sunny, overcast, partly cloudy, cloudy, moonlit, starlit, etc.), sporting arenas, opera houses, dance venues, clubs, auditoriums, bars, museums, theatres, and the like can be achieved using the mirror assembly 114. In some embodiments, the light emitted from the mirror 108 comprises a substantially full spectrum of light in the visible range. The mirror assembly 114 can be configured to permit a user to select among the different types of light (e.g., color, temperature, intensity, etc.) emitted from the one or more light sources, either on the mirror assembly 114 or from a remote source, or the mirror assembly 114 can be configured to automatically select among the different types of light emitted from the one or more light sources 126.

In some embodiments, the intensity of individual light sources 126 (e.g., LEDs or combinations of LEDs or one or more other light sources) is independently adjustable. In certain embodiments, changes in color temperatures can be achieved by pairing LEDs having one color temperature with one or more different LEDs having one or more separate color temperatures. The relative intensity of light from those LEDs can then be individually adjusted (e.g., by adjusting the brightness of one or more LEDs) to increase or decrease the color temperature. In some embodiments, changes in colors (e.g., hues, shades, tints, tones, tinges, etc.) can be achieved by pairing one or more LEDs having one color with one or more LEDs having a different color. In some embodiments, the intensity of light emitted from different colored LEDs can be individually adjusted to cause a color change (e.g., to a color an individual LED or to colors achieved through combinations of the light emitted from the LEDs—color mixing). Adjusting the relative intensity of different LEDs can allow the user to adjust the color of the light emitted by the light sources, the color temperature of the light emitted by the light sources, the brightness of the light emitted by the light sources, or combinations thereof. In some embodiments, by adjusting the intensity of individual LEDs automatically (by selecting a preset light configuration, a downloaded light configuration, or an uploaded configuration) or manually (e.g., by adjusting color, tint, brightness, intensity, temperature, or others with manual user adjustments), the light conditions for any environment can be achieved.

In some embodiments, the light sources 126 have a color temperature of greater than or equal to about 4500 K and/or less than or equal to about 6500 K. In some embodiments, the color temperature of the light sources 126 is at least about 5500 K and/or less than or equal to about 6000 K. In certain embodiments, the color temperature of the light sources 126 is about 5700 K.

In some embodiments, the light sources 126 have a color rendering index of at least about 70 and/or less than or equal to about 90. Certain embodiments of the one or more light sources 126 have a color rendering index (CRI) of at least about 80 and/or less than or equal to about 100. In some embodiments, the color rendering index is high, at least about 87 and/or less than or equal to about 92. In some embodiments, the color rendering index is at least about 90. In some embodiments, the color rendering index can be about 85.

In some embodiments, the luminous flux can be at least about 80 lm and/or less than or equal to about 110 lm. In some embodiments, the luminous flux can be at least about 90 lm and/or less than or equal to about 100 lm. In some embodiments, the luminous flux can be about 95 lm.

In some embodiments, the forward voltage of each light source can be at least about 2.4 V and/or less than or equal to about 3.6 V. In some embodiments, the forward voltage can be at least about 2.8 V and/or less than or equal to about 3.2 V. In some embodiments, the forward voltage is about 3.0 V.

In some embodiments, the light sources 126 are configured to provide multiple colors of light and/or to provide varying colors of light. For example, the light sources 126 can provide two or more discernable colors of light, such as red light and yellow light, or provide an array of colors (e.g., red, green, blue, violet, orange, yellow, and otherwise). In certain embodiments, the light sources 126 are configured to change the color or presence of the light when a condition is met or is about to be met. For example, certain embodiments momentarily change the color of the emitted light to advise the user that the light is about to be deactivated.

As shown in FIGS. 10A-10B, the light sources can be positioned near the uppermost region of the mirror assembly 114. In other embodiments, the light sources 126 are positioned at other portions of the mirror assembly 114, such as, within the light pipe 110 or directly mounted to the mirror 108 at spaced-apart intervals around the periphery of the mirror 108. For example, the light sources 126 can be positioned around some, substantially all, or all of the periphery of the mirror 108. In certain embodiments, the light sources 126 are separate from and do not connect with the mirror assembly 114.

The light sources 126 can be positioned in various orientations in relation to each other, such as side-by-side, back-to-back, or otherwise. In certain embodiments, the light sources 126 can be positioned to emit light in opposing directions. For example, a first light source can project light in a first direction (e.g., clockwise) around the periphery of the mirror 108, and a second light source can project light in a second direction (e.g., counter-clockwise) around the periphery of the mirror 108. In certain embodiments, the light sources 126 can be positioned to emit light generally orthogonally to the viewing surface of the mirror assembly 114. In certain embodiments, the light sources 126 can be positioned to emit light tangentially in relation to the periphery of the mirror 108.

As shown in FIG. 10A, in some embodiments, the mirror assembly 114 can include a light conveying channel 146. The light conveying channel 146 can be configured to permit light to pass along the channel. For example, in some embodiments, a light pipe 110 can be positioned in the light conveying channel 146.

A support portion 130 can support the mirror 108 and a light conveying structure, such as a light pipe 110, positioned around at least a portion of a periphery of the mirror 108. In some embodiments, the light pipe 110 is positioned only along an upper portion of mirror 108 or a side portion of the mirror 108. In other embodiments, the light pipe 110 extends around at least majority of the periphery of the mirror 108, substantially the entire periphery of the mirror 108, or around the entire periphery of the mirror 108.

Some or all of the light from the light sources 126 can be transmitted generally toward, or into, the light pipe 110. For example, the light pipe 110 can include ends, and the light sources 126 can emit light into one or both of the ends of the light pipe 110. The light sources 126 can be positioned such that the light is emitted generally toward a user facing the viewing surface of the mirror assembly 114. For example, some or all of the light from the light sources 126 and/or the light pipe 110 can be emitted toward, and reflected off of, another component before contacting the user. In some embodiments, the light sources 126 are positioned behind the mirror 108 (e.g., creating a backlighting effect of the mirror 108). In some embodiments, the light sources 126 are positioned (e.g., by tilting) such that light emitted from the light sources 126 contacts the viewing surface of the mirror assembly 114 at an angle, such as an acute angle. In some embodiments, the light sources 126 are positioned such that light emitted from the light sources 126 contacts the viewing surface of the mirror assembly 114 at an obtuse angle.

The light pipe 110 can have a radial width and an axial depth. Some variants have a radial width that is greater than or equal to than the axial depth. In certain implementations, the light pipe 110 is configured to provide adequate area for the reflecting surface of the mirror 108 and to provide sufficient area for light to be emitted from the light pipe 110, as will be discussed in more detail below. For example, the ratio of the radial width of the light pipe 110 to the radius of the mirror 108 can be less than or equal to about: 1/5, 1/15, 1/30, 1/50, values in between, or otherwise.

As shown in FIG. 9A, the light pipe 110 can be substantially circularly shaped. The light pipe 110 can include a gap, and a sensor assembly and/or the light sources 126 can be positioned in the gap. In some embodiments, the light pipe 110 can be substantially linearly shaped, or the light pipe 110 has a non-linear and non-circular shape. The light pipe 110 can include acrylic, polycarbonate, or any other clear or highly transmissive material. The light pipe 110 can be at least slightly opaque.

The light can pass along and through a portion of the light pipe 110 and/or emit from the light pipe 110 via an outer face of the light pipe 110. In some embodiments, the light pipe 110 is configured to transmit at least about 95% of the light emitted from the light sources 126. The light sources 126 can be configured, in combination with light pipe 110, to emit light generally around the periphery of the mirror 108. The light pipe 110 can be configured to disperse light from the light sources 126 through the light pipe 110. The light sources 126 and the light pipe 110 can be configured such that the amount of light emitted from the outer face is substantially constant along the length of the light pipe 110. Many different ways of achieving a substantially constant intensity of conveyed light around the light pipe 110 can be used.

The support portion 130 and/or the light pipe 110 can include features to facilitate generally even or uniform diffusion, scattering, and/or reflection of the light emitted by the light sources 126 around the periphery of the mirror. For example, the support portion 130 and/or light pipe 110 can include an irregular anterior and/or posterior surface that is molded in a non-flat and/or non-planar way, etched, roughened, painted, and/or otherwise surface modified. The light scattering elements can be configured to disperse a substantially constant amount of light along the periphery of the mirror 108. These features can help achieve high energy-efficiency, reducing the total number of light sources necessary to light substantially the entire periphery of the mirror and reducing the temperature of the mirror assembly 114.

The light pipe 110 can comprise a generally translucent material with varying degrees of scattering, such that the minimum amount of scattering occurs in a region near the light source(s) and the maximum scattering occurs in a region of the light pipe 110 that is located furthest from the light source(s). The light pipe 110 can comprise a region configured to scatter light in a varying manner. In some embodiments, the light conveying pathway or light pipe 110 can comprise a varying, non-constant, non-smooth anterior, posterior, and/or interior surface formed from any suitable process, such as molding, etching, roughening painting, coating, and/or other methods. In some embodiments, one or more surface irregularities can be very small bumps, protrusions, and/or indentations.

In some embodiments, light passing through the light pipe 110 can be scattered at a plurality of different intensity levels, depending on the location of the light within the light pipe 110. For example, light at a first location on the light pipe 110 can be scattered at a first intensity level, light at a second location on the light pipe 110 can be scattered at a second intensity level, and light at a third location on the light pipe 110 can be scattered at a third intensity level, with the third intensity level being more than the second intensity level, and the second intensity level being more than the first intensity level, etc. Many other levels of scattering and many ways of spatially increasing or decreasing scattering can be used instead of or in addition to providing macro scattering elements, such as spatially varying a level of die or a frosting effect within the material of the light pipe 110, or by spatially varying scattering particles embedded within the material, or by spatially varying a surface pattern on one or more outside surfaces of the material.

The light pipe 110 can include a surface pattern, such as light scattering elements (e.g., a dot pattern). The light scattering elements can be configured to encourage a portion of the light passing through the light pipe 110 to exit the outer face of the light pipe 110, thereby generally illuminating the user in a generally even or generally uniform manner. The light scattering elements can be configured such that the light intensity emitted from the outer face of the light pipe 110 is substantially constant along a substantial portion of, or virtually the entirety of, the length of the light pipe 110. Accordingly, the user can receive generally constant light volume or intensity around the periphery of the mirror 108. For example, the light scattering elements can include one or more of varied density, irregular patterns, or varied sizes.

The light scattering elements can be less dense near the light sources 126, and become increasingly dense as a function of increased distance from the light sources 126.

Such a configuration can, for example, reduce the amount of light that is scattered or reflected (and thus exits the outer face) in areas having generally increased light volume or light intensity, such as portions of the light pipe 110 that are near the light sources 126. Further, such a configuration can encourage additional scattering or reflection (and thus increase the amount that exits the outer face) in areas having generally decreased light volume or intensity, such as portions of the light pipe 110 that are spaced away from the light sources 126. Accordingly, the mirror assembly 114 can avoid bright areas at some portions of the periphery of the mirror 108 and dark areas at other portions. The mirror assembly 114 can have a substantially constant amount of light emitted along some, substantially all, or all of the periphery of the mirror 108.

The light scattering elements can be dispersed in an irregular pattern, such that the light scattering pattern in a first region is different than a light scattering pattern in a second region. A distance between a first light scattering element and a second light scattering element can be different than a distance between a first light scattering element and a third light scattering element.

The sizes (e.g., the diameter) of the light scattering elements can be varied. In some variants, the light scattering elements near the light sources 126 can have a smaller size when compared to light scattering elements that are farther from the light sources 126. For example, the light scattering elements can include a smaller diameter near the light sources 126 and become increasingly larger as a function of distance from the light sources 126. Such a configuration allows substantially even reflection of light to the outer surface. In certain embodiments, each light scattering element has a diameter of less than or equal to about one millimeter. In some embodiments, the light scattering elements each have a diameter greater than or equal to about one millimeter.

In some embodiments, the light scattering elements can be generally circular. In some embodiments, the light scattering elements have other shapes, such as generally square, generally rectangular, generally pentagonal, generally hexagonal, generally octagonal, generally oval, and otherwise. In certain embodiments, the pattern in the light pipe 110 is a series of lines, curves, spirals, or any other pattern. In certain embodiments, the light scattering elements are white. The light scattering elements can be dispersed such that the light pipe 110 appears frosted. In some embodiments, the light scattering elements are not easily visible to the user. For example, the light pipe 110 can be slightly opaque to conceal the appearance of the surface pattern. In some embodiments, the light scattering elements are visible to the user, the light pipe 110 can be clear to show the general color and pattern of the surface elements.

In certain variants, the mirror assembly 114 can also include a diffuser 140. The diffuser 140 can be positioned on the surface of the light pipe 110 and/or around the periphery of the mirror 108. For example, the diffuser 140 can be positioned between the light pipe 110 and the user to provide a diffuse, scattered light source, not a focused, sharp light source, which would be less comfortable on the user's eyes. In some embodiments, the transmissivity of the diffuser 140 is substantially constant along its length. In certain embodiments, the diffuser 140 can extend the length of light pipe 110. The diffuser 140 can include an at least partially opaque material. For example, the diffuser 140 can include optical grade acrylic.

The diffuser 140 can include an irregular anterior and/or posterior surface formed from etching, roughening, painting, and/or other methods of surface modification. For example, the diffuser 140 can include a pattern of light scattering elements created using any of the methods discussed herein. The light scattering elements can be modified to include any of the shapes and/or sizes discussed in connection with the light pipe 110.

The light pipe 110 can include a reflective material to achieve high reflectivity. For example, the light pipe 110 can include a reflective backing material 142 along the rear side of the light pipe. In some embodiments, the reflective material can reflect at least about 95% of light. In some embodiments, the reflective material reflects about 98% of light. The reflective material can be optically reflective paper. The reflective material can comprise any material that provides high reflectivity, such as a metallic surface or a white surface.

In some embodiments, a cover member can cover a sensor assembly and the light sources 126. The cover member can be clear and polished acrylic, polycarbonate, or any other suitable material. On the rear side, the housing portion 116 can include a rear cover portion 134, which can be configured to at least partially enclose one or more components of the mirror assembly 114. The rear cover portion 134 can include an aperture through which the orienting structure 120 can extend and/or be accessible to the user. The rear cover portion 134 can also include one or more vents to further reduce the temperature.

Figure 12:
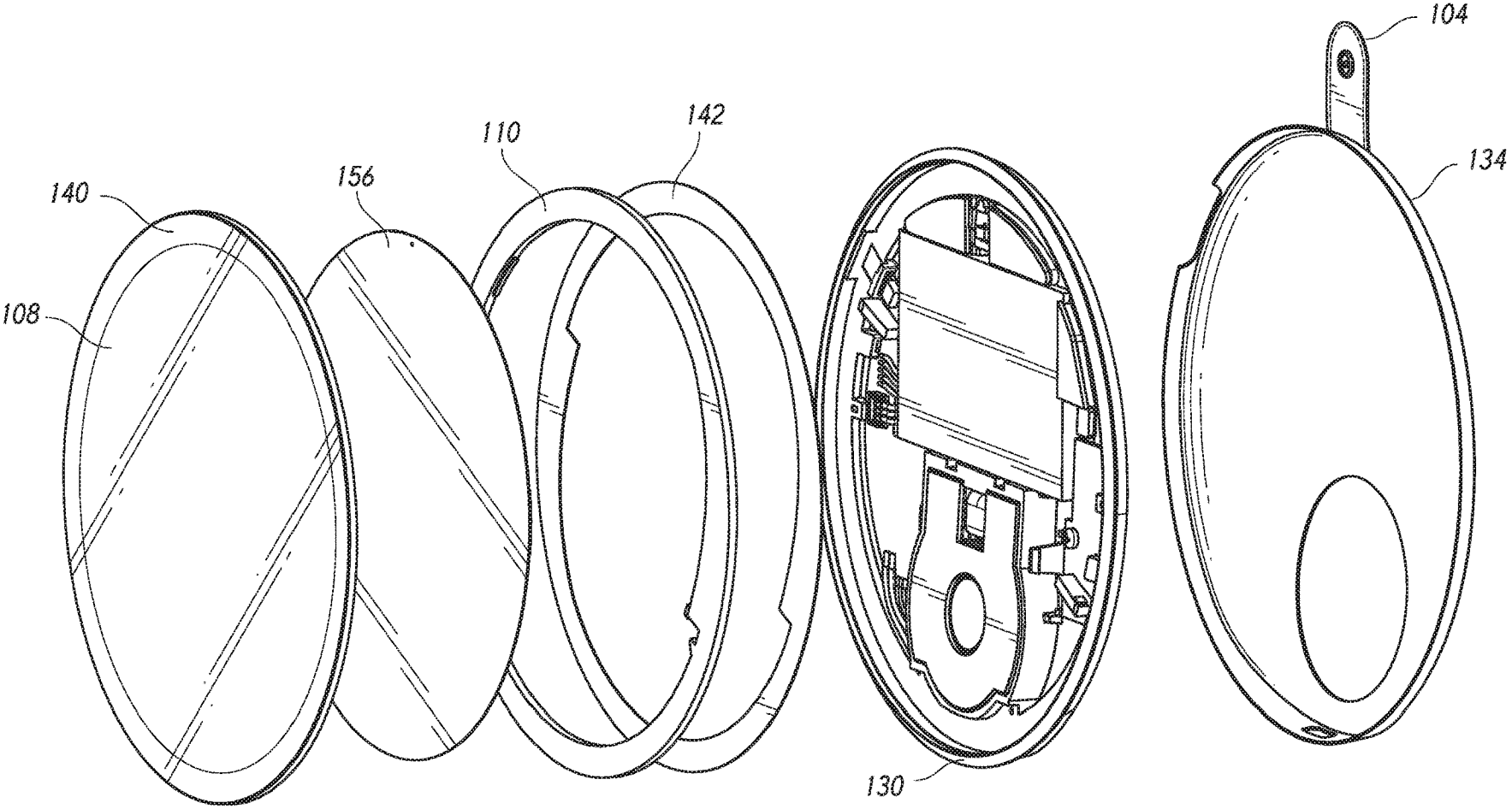
FIG. 12 illustrates an exploded view of a portion of the embodiment of FIG. 7.

As shown in FIG. 12, in some embodiments, the mirror assembly 114 can include a mounting surface 156. The mounting surface 156 can be positioned between the diffuser 140 and the light pipe 110. In some embodiments, the mounting surface 156 can provide a surface on which to mount the mirror 108. For example, in some embodiments, the mirror 108 can be mounted to the mounting surface 156 using glue. In some embodiments, the mounting surface 156 can be configured to shield, protect, segment, and/or isolate components of the mirror assembly 114. For example, the mounting surface 156 can segment or section off internal components of the mirror assembly 114 that may be hot, such as the light sources 126 or the battery 132, from other components of the mirror assembly 114. In some embodiments, the mounting surface 156 can comprise rubber, silicone, plastic, and/or any other suitable materials. In some embodiments, the mounting surface 156 can be circular, rectangular, square, and/or any other suitable shape.

Figure 8A:
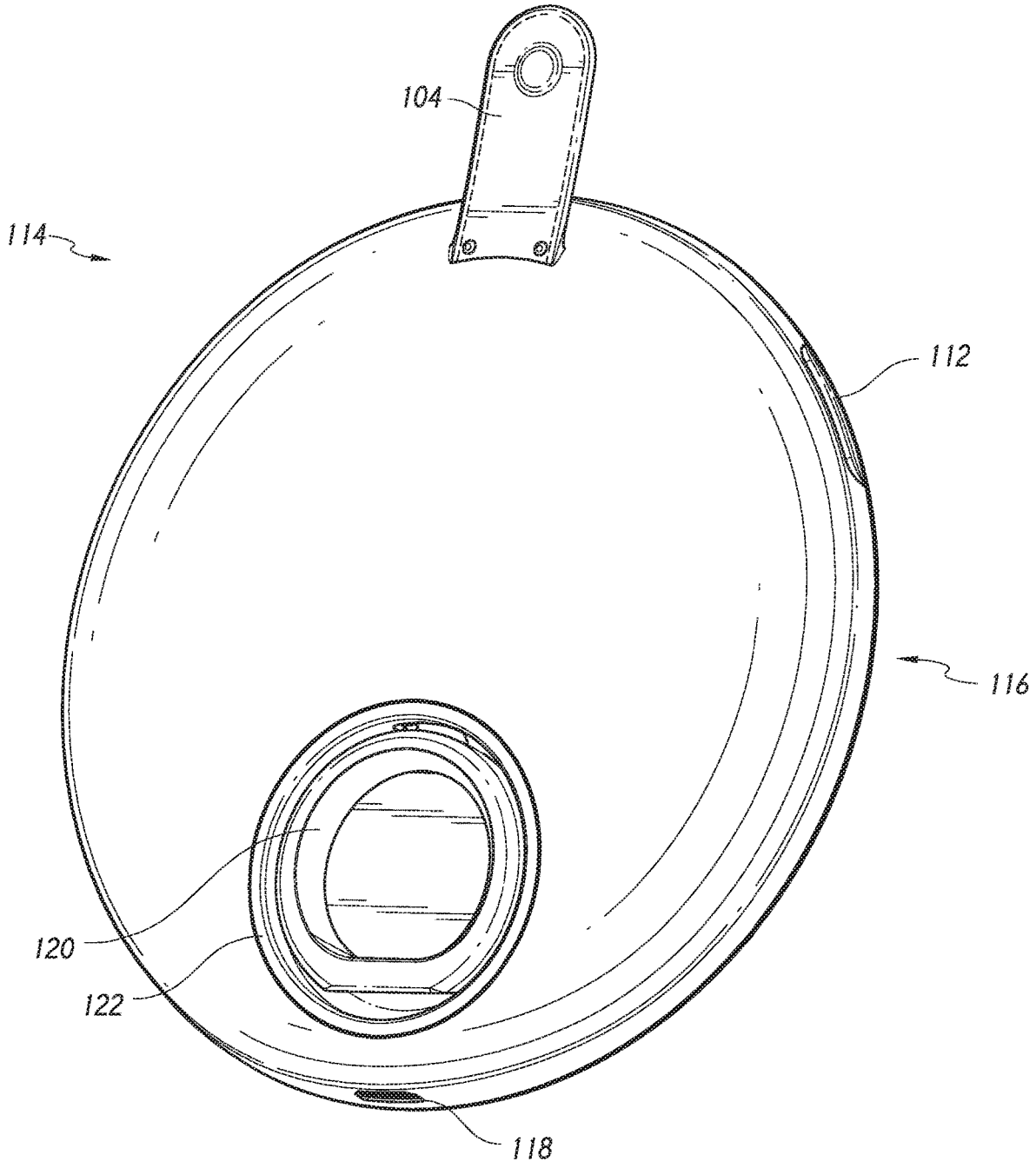
FIG. 8A illustrates a rear perspective view of the embodiment of FIG. 7.

As discussed in further detail below, the mirror assembly 114 can include a battery 132 (e.g., a rechargeable battery). In some embodiments, the battery 132 can deliver power to the light sources 126 for at least about ten minutes per day for about thirty days. The battery 132 can be recharged via a port 118 (e.g., a universal serial bus (USB) port or otherwise), as shown in FIG. 8A. In some embodiments, the mirror assembly 114 can include a charging board 154 configured to control or operate the port 118. The port 118 can be configured to permanently or removably receive a connector coupled with a wire or cable (not shown). The port 118 can also be configured to allow electrical potential to pass between the battery 132 with a power source via the connector. The port 118 may be used to program or calibrate different operations of the mirror illumination or object sensing when connect to a computer. Other charging methods can be used, such as via conventional electric adapter to be plugged in to an electric outlet.

The mirror assembly 114 can include an indicator device configured to issue a visual, audible, or other type of indication to a user of the mirror assembly 114 regarding a characteristic of the mirror assembly 114, the user, and/or the relationship between the mirror assembly 114 and the user. For example, the indicator can indicate on/off status, battery levels, imminent deactivation, and/or certain mode of operation. The indicator can be used for other purposes as well.

In certain embodiments, the color of the indicator light can vary depending on the indication. For example, the indicator can emit a green light when the mirror assembly is turned on and/or a red light when the battery 132 is running low. In some embodiments, the indicator can be configured to emit two or more colors of light (e.g., green or red) and/or patterns of light (flashing or continuous lighting) to convey information regarding one or more different stages or statuses of the mirror assembly 114 to the user, such as low battery, state of charge of battery, completion of charging, or communication with an external data source.

The indicator can be positioned at a location along the support portion 130, or on any other location on the mirror assembly 114 or mirror system 100. For example, the indicator can be configured to illuminate at least a portion of the light pipe 110 to indicate to the user that the battery 132 is low.

The controller 136 can be configured to control the operation of light sources 126 and/or any one or more of any other electronically enabled functions disclosed anywhere in this specification. The controller 136 can be disposed in the housing portion 116 and can include one or a plurality of circuit boards (PCBs), which can provide hard wired feedback control circuits, a processor, and a memory devices for storing and performing control routines, or any other type of controller. Any electronic board or electronic component configured to control an electronic function can form part of a centralized or decentralized controller, including any of those disclosed throughout this specification.

The mirror assembly 114 can include a sensor assembly. The sensor assembly can be positioned near an upper region of the mirror assembly 114 (e.g., the top of the mirror). For example, the sensor assembly can be positioned in a gap in the light pipe 110. The sensor assembly can also be recessed from the front surface of the mirror assembly 114. Alternatively, the sensor assembly can disposed along any other portion of the mirror assembly 114 or not positioned on the mirror assembly 114. For example, the sensor assembly can be positioned in any location in a room in which the mirror assembly 114 sits. The sensor assembly can include a proximity sensor or a reflective-type sensor. For example, the sensor can be triggered when an object (e.g., a body part) is moved into, and/or produces movement within, a sensing region.

The sensor assembly can include a transmitter and a receiver. The transmitter can be an emitting portion (e.g., electromagnetic energy such as infrared light), and the receiver can be a receiving portion (e.g., electromagnetic energy such as infrared light). The beam of light emitting from the light emitting portion can define a sensing region. In certain variants, the transmitter can emit other types of energy, such as sound waves, radio waves, or any other signals. The transmitter and receiver can be integrated into the same sensor or configured as separate components.

In some embodiments, the light emitting portion can emit light in a generally perpendicular direction from the front face of the mirror assembly. In some embodiments, the light emitting portion emits light at a downward angle from a perpendicular to the front face of the mirror assembly by at least about 5 degrees and/or less than or equal to about 45 degrees. In some embodiments, the light emitting portion emits light at a downward angle from a perpendicular to the front face of the mirror assembly by at least about 15 degrees and/or less than or equal to about 60 degrees. In certain embodiments, the light emitting portion emits light at a downward angle of about 15 degrees.

In some embodiments, the sensor assembly can detect an object within a sensing region. In certain embodiments, the sensing region can have a range from at least about 0 degrees to less than or equal to about 45 degrees downward relative to an axis extending from the sensor assembly, and/or relative to a line extending generally perpendicular to a front surface of the sensor assembly, and/or relative to a line extending generally perpendicular to the front face of the mirror and generally outwardly toward the user from the top of the mirror assembly. In certain embodiments, the sensing region can have a range from at least about 0 degrees to less than or equal to about 25 degrees downward relative to any of these axes or lines. In certain embodiments, the sensing region can have a range from at least about 0 degrees to less than or equal to about 15 degrees downward relative to any of these axes or lines.

In some embodiments, the sensing region can be adjusted by mounting the sensor assembly at an angle. In certain embodiments, the sensor assembly can be mounted such that the front surface of the sensing assembly can be generally parallel or coplanar with a front surface of mirror 108. In certain embodiments, the sensor assembly can be mounted such that the front surface of the sensing assembly can be at an angle relative to the front surface of the mirror.

In some embodiments, the sensing region can be adjusted by modifying one or more features of a cover member. In certain embodiments, the cover member can include a lens material. In certain embodiments, the cover member can include a generally rectangular cross-section. In certain embodiments, the cover member can include a generally triangular cross-section. In certain embodiments, the cover member can include a front surface generally parallel or coplanar with a front surface of the mirror 108. In certain embodiments, the cover member can include a front surface at an angle relative to the front surface of the mirror 108. In certain embodiments, the front surface of the cover member can be positioned at an angle relative to the sensor assembly.

If the receiving portion detects reflections (e.g., above a threshold level) from an object within the beam of light emitted from the light emitting portion, the sensor assembly can send a signal to the controller to activate a light source.

The sensor assembly can send different signals to the controller 136 based on the amount of light reflected back toward the receiver. For example, the sensor assembly can be configured such that the amount of light emitted by the light sources 126 is proportional to the amount of reflected light, which can indicate the distance between the mirror 108 and the user. In certain variants, if the user is in a first sensing region, then the controller causes the one or more light sources 126 to activate from an off state or to emit a first amount of light. If the user is in a second sensing region (e.g., further away from the sensor assembly than the first sensing region), then the controller causes the one or more light sources 126 to emit a second amount of light (e.g., less than the first amount of light).

The controller 136 can trigger at least two different levels of brightness from the light sources 126, such as brighter light or dimmer light. For example, if the user is anywhere in a first sensing region, then the controller 136 signals for bright light to be emitted; if the user is anywhere in a second sensing region, then the controller 136 signals for dim light to be emitted.

The controller 136 can also trigger more than two brightness levels. In certain implementations, the level of emitted light is related (e.g., linearly, exponentially, or otherwise) to the distance from the sensor to the user. For example, as the user gets closer to the sensor assembly, the one or more light sources 126 emit more light. Alternatively, the mirror assembly 114 can be configured to emit more light when the user is further away from the sensor assembly, and less light as the user moves closer to the sensor assembly.

Once a light source 126 activates, the light source 126 can remain activated so long as the sensor assembly detects an object in a sensing region. Alternatively, the light source 126 remains activated for a pre-determined period of time. For example, activating the light source 126 can initialize a timer. If the sensor assembly does not detect an object before the timer runs out, then the light source 126 is deactivated. If the sensor assembly 126 detects an object before the timer runs out, then the controller 136 reinitializes the timer, either immediately or after the time runs out.

The one or more sensing regions can be used in any type of configuration that allows the user to control an aspect of the operation of the mirror assembly 114. For example, the one or more sensing regions can be used to trigger the mirror assembly 114 to emit different levels of light, operate for varying durations of time, pivot the mirror, or any other appropriate parameter.

In some embodiments, the mirror assembly 114 has one or more modes of operation, for example, an on mode and an off mode. In some embodiments, the mirror assembly 114 can be turned on and off manually by a user, such as by actuation of a button 112 on the device, by engaging a touchscreen, or by other similar means. The button 112 can be positioned on any portion of the mirror assembly 114 (e.g., the button can be positioned on a side or on the back of the mirror assembly). In some embodiments, actuation of the button 112 can enable or disable the feature of the mirror assembly 114 that causes the mirror assembly 114 to illuminate when it is removed from the holder 102. For example, if the user wants to conserve battery power, the user can configure the mirror assembly 114 such that it does not turn on and off upon removal from or return to the holder 102, respectively. In some embodiments, the mirror assembly 114 can turn on and off upon removal from or return to the holder 102, respectively, and can additionally be turned on and off by actuation of the button 112, by engaging a touchscreen, or by other similar means.

The mirror assembly 114 can also include ambient light sensing capabilities. For example, when the ambient light is relatively low, the light emitting from the light source 126 will be brighter than if the ambient light is relatively bright. The light receiving portion can detect both ambient light and light emitted from the transmitter, or the mirror assembly 114 can include a second sensor assembly for detecting ambient light.

The controller 136 can adjust the amount of signal necessary to trigger a light source 126 based on the amount of detected ambient light. For example, the amount of detected light required to activate the light sources 126 can be proportional to the ambient light. Such a configuration can allow the light source 126 to be activated even when the level of ambient light is modest (e.g., in dimmed bathroom lighting). When the ambient light is less than or equal to a first level, the controller 136 activates light source 126 when a first level of the reflected signal is detected. When the ambient light is greater than the first level, the controller 136 activates light source 126 when a second level (e.g., greater than the first level) of the reflected signal is detected.

The controller 136 can also adjust the amount of light emitted by the light sources 126 based on the ambient light. Such a configuration can, for example, avoid emitting a starting burst of very bright light that would be uncomfortable to a user's eyes, especially when the user's eyes were previously adjusted to a lower light level, such as when the surrounding environment is dim. For example, the amount of light emitted by the light sources 126 can be proportional to the amount of ambient detected light.

The controller 136 can also gradually increase the level of emitted light from the light sources 126 when the light sources 126 are activated and/or gradually decrease the amount of light emitted from the light sources 126 when the light sources 126 are deactivated. Such a configuration can inhibit discomfort to a user's eyes when the light sources 126 turn on.

In some embodiments, the mirror assembly 114 can include an algorithm configured to maintain the light source (e.g., LED) brightness at a generally constant level even as the battery capacity is nearing the end of its life (necessitating a recharge) by adjusting the electrical characteristics of the power source supplied to the light source depending on the stage of battery life (e.g., increasing the voltage as the current decreases or increasing the current as the voltage decreases).

In some embodiments, the mirror assembly 114 can include an algorithm configured to detect whether the mirror was inadvertently activated, such as with a false trigger or by the presence of an inanimate object. For example, when the sensor detects an object, the controller can initialize a timer. If the mirror assembly 114 does not detect any movement before the timer runs out, then the light sources will turn off. If the mirror assembly 114 does detect movement, then the timer can re-initialize.

As noted above, the mirror assembly 114 can include a processor, which can control, by various scheme and algorithms, input and output characteristics and functions of the mirror assembly 114. The mirror assembly 114 can also include memory, such as firmware, to store the various control schemes and algorithms, as well certain instructions and/or settings related to various characteristics of the mirror assembly 114. For example, the memory can include instructions and/or settings regarding the size of the sensing regions, the sensitivity of the sensors, the level of output light, the length of various timers, and otherwise.

The mirror assembly 114 can be configured such that a user can modify (e.g., update, program, or otherwise) the memory, such as by connecting the mirror assembly 114 to a computer. For example, the mirror 114 can be communicatively connected with a computer via the port 118 (e.g., using a USB cable). Data can be transferred between the computer and the mirror assembly 114 via the port 118. The mirror assembly 114 can alternatively be configured to communicate with a computer wirelessly, such as by a cellular, Wi-Fi, or Bluetooth® network, infrared, or otherwise.

When the mirror assembly 114 is in communication with the computer, a control panel may be displayed on the computer. The control panel may allow the user adjust various input and output characteristics for the mirror assembly 114. For example, a user can use the control panel to adjust the output of the emitting portions and/or the sensitivity of the transmitter. The user can also configure the light levels associated with the first and second sensing regions. In another example, the user can adjust the size (e.g., depth, width, and/or height) of one or more of the sensing regions. In some implementations, the user can use the control panel to modify the operation and output (e.g., intensity and/or color of the light) of the light source 126 based on certain conditions, such as the time of day, level of ambient light, amount of battery power remaining, and otherwise. In certain variants, the ability to modify the operational parameters of the mirror assembly 114 with the control panel can reduce or obviate the need for one or more adjustment devices (e.g., buttons, knobs, switches, or the like) on the mirror assembly 114, thereby providing a generally uniform exterior surface of the mirror assembly 114 (which can facilitate cleaning) and reducing the chance of unintentional adjustment of the operational parameters (such as when transporting the mirror assembly 114).

In some embodiments, a database containing light information for particular environments can be assembled (e.g., by a user or a third party) and stored in the memory on the mirror assembly 114 and/or on the computer. This database can contain, for example, particular light parameters (e.g., color temperature, light intensity, color hue, etc.) for individual environments (e.g., restaurants, outdoor venues at different times of day or season or with different weather conditions, sporting arenas, opera houses, dance venues, clubs, auditoriums, office, bar, etc.). In certain embodiments, individual outside light environments can include, for example, sunny, overcast, cloudy, rainy, dawn, dusk, twilight, etc. In some embodiments, a user can access this database in setting the light parameters of the mirror assembly 114 in order to perform light-matched personal grooming and make-up application (e.g., in preparation for attending a database-listed or similar venue). For instance, in certain variants, the user can download a venue's light parameters into a device (e.g., a handheld device, a tablet, a computer, a thumb drive, a smartphone) and transfer that information to the mirror assembly 114 (e.g., by connecting the device to the mirror assembly 114 using a conduit and the port 118 or wirelessly using Bluetooth® or Wi-Fi). Once downloaded (e.g., to a processor or to a memory storage unit), the mirror assembly 114 can automatically set the light parameters to match the suggested settings in the database. In some embodiments, any of these light settings can be preset and/or included on a memory of the mirror assembly 114 (e.g., without need for download from a database). In some embodiments, the user can manually select any of these preset settings (e.g., using a touch screen, capacitive touch sensor, buttons, a wireless device, etc.) or the user can manually create and save one or more different settings from the user's own personal adjustments. Personal (e.g., manual) adjustments can be performed by manipulating one or more of the tint, color, color temperature, brightness, and light intensity of the light emitted from the light assembly (e.g., using a touch screen, capacitive touch sensor, buttons, a wireless device, etc.).

In some embodiments, the mirror assembly 114 can be configured to access environmental information (date, time, season, weather, etc.) from an information source (e.g., the internet, a home system, etc.). In some embodiments, this information can be transferred to the mirror assembly 114 wirelessly or through a wired connection. In some embodiments, the mirror assembly 114 can include a software or hardware module with an algorithm that selects particular light parameters automatically based on the environmental information to best match those conditions. In some embodiments, the mirror assembly 114 comprises learning devices and/or can be integrated to communicate with such devices (e.g., NEST® devices). In some embodiments, this feature allows the mirror assembly to function and/or program or adjust itself based on user activity (e.g., whether the user is home, in bed, in the bathroom, etc.) and/or based on information gathered by an integrated device (e.g., a NEST® device). In some embodiments, after information is received, the mirror assembly can automatically select lighting settings based on, for example, outside weather (e.g., outside lighting conditions), ambient lighting, the presence of someone in the home (e.g., for power conservation, etc.), time of the day (e.g., to act as an alarm by flashing light, a night light, etc.), or otherwise. In some embodiments, any of the above features can be turned-off or overridden based on input from the user.

In some embodiments, the software or hardware module in the mirror assembly 114 or computer can be configured to enable a user to set particular default settings of the mirror assembly 114 using a computing device (e.g., a computer, smartphone, or the like) to download particular desired settings from the mirror assembly (e.g., a favored color temperature, light intensity, color hue, etc.). In certain variants, software or hardware module in the mirror assembly 114 or computer can be configured to enable the user can later reset the mirror assembly 114 to those desired settings by uploading them from the computing device (e.g., wirelessly, wired, or otherwise). In certain embodiments, the user can set particular mirror assembly 114 settings (e.g., lighting settings, mirror positions, etc.) and save/store those settings.

In some embodiments, when attending a particular venue, the user can use a sensing device in the mirror assembly 114 or on another device (e.g., on a smart phone, other mobile electronic communication device, or another data collecting device) to detect particular light parameters of the environment. In certain implementations, the user can then capture light information at the venue using the sensing device. The user can later use this light parameter information to calibrate the mirror assembly 114 to match that particular environment (or to create a new preset light environment that can be stored in a memory of the mirror assembly). In some embodiments, an application (software, etc.) can be loaded onto the sensing device to allow the user to capture light information at a particular venue. In some variants, for instance, a light environment capture application (available at an app store or online) is downloaded to a mobile communication device and when the app is opened, light information can be captured automatically, by actuation of a button on the device, or by touching engaging a touchscreen. In some embodiments, the user can gather lighting information, such as by taking a picture or a "selfie" using the sensing device. Then, in certain implementations, the lighting information or picture or "selfie" can be analyzed by software or an application to capture light environment information therefrom.

In some embodiments, a calibrating implement can be used to detect particular light parameters of the environment. For instance, in certain implementations, a calibrating card can be used. In some variants, the calibrating card contains various shapes or images with various colors, or shades of colors. In some embodiments, when the sensing device views the calibrating card (e.g., when ambient light that is reflected off the card is sensed by the sensing device), the light parameters of the environment are captured.

Other types of interactions (additionally or alternatively) between the mirror assembly 114, mobile devices, and a user are possible in addition to those described above. For example, a user may be able to input data into or control the mirror assembly 114 through other devices, such as keyboards, mouses, or remote controls. In some embodiments, the mirror assembly 114 settings can be implemented with one or more computing devices, such as several interconnected devices. Thus, each of the components depicted in the mirror assembly 114 can include hardware and/or software for performing various features.

When the mirror assembly 114 is in communication with the computer, data can be transferred from the mirror assembly 114 to the computer. For example, the mirror assembly 114 can transfer data, such as power consumption, estimated remaining battery power, the number of activations and/or deactivations of the light source 126, the length of use (e.g., of individual instances and/or in total) of the light source 126, and otherwise. Software can be used to analyze the transferred data, such as to calculate averages, review usage statistics (e.g., during specific periods), recognize and/or draw attention to unusual activity, and display usage statistics on a graph. Transferring usage statistics from the mirror assembly 114 to the computer allows the user to monitor usage and enables the user to calibrate different characteristics of the mirror assembly 114 (e.g., based on previous usage and parameters). Transferring data from the mirror assembly 114 to the computer can also reduce or avoid the need for one or more adjustment or display devices on the mirror assembly itself.

When the mirror assembly 114 is in communication with the computer, the computer can also transfer data to the mirror assembly 114. Furthermore, when the mirror assembly 114 is in communication with the computer, electrical potential can be provided to the battery 132 before, during, or after such two-way data transfer.

In some embodiments, an additional mirror 138 can be provided. This additional mirror 138 can be used to supplement the image provided on the mirror 108 by providing additional views of the user. For instance, in some embodiments, where the mirrored surface of the mirror assembly 114 is flat, the additional mirror 138 can be parabolic (e.g., concave) and/or can provide magnified views of the user. In certain implementations, the parabolic shape of the additional mirror 138 can allow the user to increase or decrease magnification by moving closer or farther from the additional mirror 138. The radius of curvature and focal length of the additional mirror 138 can vary as described elsewhere herein. In some embodiments, the additional mirror 138 is convex and provides a smaller image of the user. This smaller image can be used to more easily allow the user look at the back of his or her head or to provide additional viewing angles of the user.

In some embodiments, a plurality of additional mirrors are provided (1, 2, 3, 4, or more), such as where each additional mirror provides a different type of image to the user (higher or lower magnification, tinted mirrors, colored mirrors, for example). In some embodiments, a single additional mirror 138 itself can provide multiple different images. For instance, an additional mirror 138 can have one face on a side and another different face on the opposite side. One face of the additional mirror 138 could be concave providing a first magnification (e.g., 10×) and the other side of the mirror (the back surface) could be concave providing a second magnification (e.g., 2×) that is different or less than or greater than the first magnification. Any other first and second different optical features can be provided by the additional mirror, on its respective opposing sides, or as compared to the mirrored surface of the mirror system 114. For example, either or both of the surfaces of the additional mirror 138, as compared to each other or as compared to the mirrored surface of the mirror system 114, can provide different reflectivity levels or different light filtering or different magnification levels. In this configuration, by simply flipping the additional mirror 138 from one side to the other, magnification or another feature of the mirror can be changed.

In some embodiments, the additional mirror 138 can be temporarily or permanently affixed (adhered, attached, etc.) to a mirrored surface of the mirror assembly 114. In some implementations, the mirror is affixed using a coupling implement, such as one selected from one or more of a magnet, suction cup, glue or silicon adhesive, a sticky pad(s), or the like (not pictured). In some embodiments, the additional mirror 138 can be removed and reaffixed to the mirror assembly 114 as many times as desired by the user and in any position on the mirror assembly (e.g., on any portion of a mirrored surface).

Figure 8B:
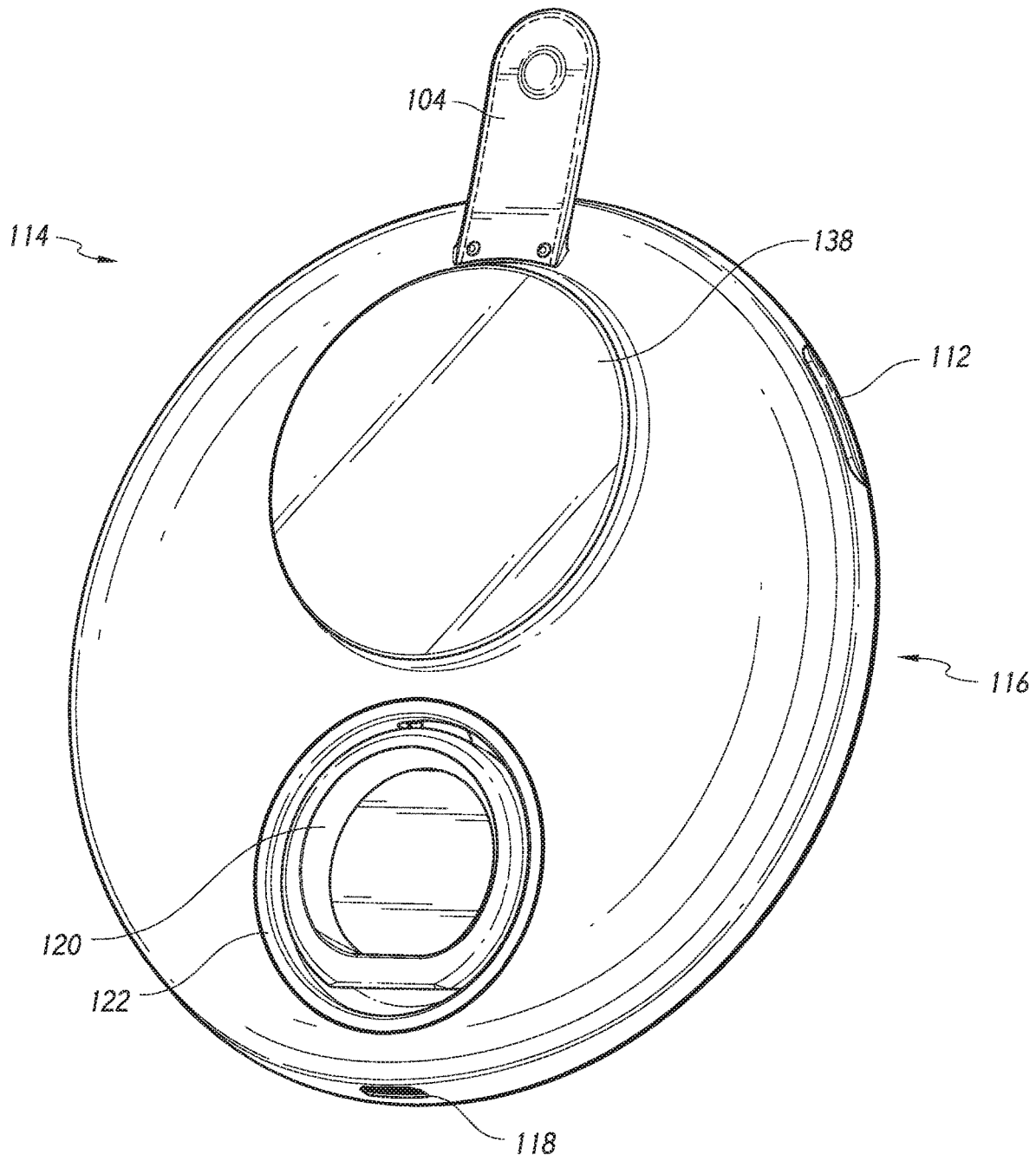
FIG. 8B illustrates a rear perspective view of an embodiment of a mirror assembly.

In some variants, the additional mirror 138 can be removable from the mirror assembly 114 to provide an unobstructed view of the image provided by the mirror assembly 114. In some embodiments, as shown in FIG. 8B, when the additional mirror 138 is not in use, it can be stored out of view (e.g., on the back of the mirror assembly 114 or in the holder). The additional mirror 138 can be stored on the back of the mirror assembly 114 using clamps. In some embodiments, the additional mirror 138 can be stored by, for example, magnetically attaching it to a portion of the mirror assembly 114 (e.g., the back/non-mirrored surface of the mirror assembly), by sliding it into a slot provided on the back or side of the mirror assembly 114 (e.g., a pocket, port, or drawer provided on the mirror assembly), by hanging it from the mirror assembly 114 (e.g., using retractable or static hooks or clips that project from a portion of the additional mirror or from the mirror assembly), or by otherwise attaching the additional mirror 138 to the mirror assembly 114 (e.g., with adhesives, etc.). Just as the additional mirror 138 can be affixed anywhere to the front of the mirror (e.g., an upper, lower, or central portion near the top, side, middle of the mirror), in some embodiments, the additional mirror 138 can be stored anywhere on the back of the mirror (e.g., an upper, lower, or central portion near the top, side, middle of the back of the mirror).

In some embodiments, as shown in FIG. 8B, the additional mirror 138 is circular. In some embodiments, the additional mirror 138 is another shape (square, rectangular, oval, etc.). In some embodiments, the additional mirror 138 is at least about 2 inches in diameter (or width or height). In some embodiments, the additional mirror 138 is sized to fit easily in a user's palm so that it can be handheld and manipulated easily when not attached to the mirror assembly 114.

Although the compact mirror has been disclosed in the context of certain embodiments and examples, it will be understood by those skilled in the art that the present disclosure extends beyond the specifically disclosed embodiments to other alternative embodiments and/or uses of the subject matter and obvious modifications and equivalents thereof. In addition, while several variations of the vanity mirror have been described in detail, other modifications, which are within the scope of the present disclosure, will be readily apparent to those of skill in the art based upon this disclosure. It is also contemplated that various combinations or sub-combinations of the specific features and aspects of the embodiments can be made and still fall within the scope of the present disclosure. All uses of terms commonly associated with circles in this specification, such as "diameter" or "radius" or "circumference" should be deemed to be applicable and disclosed in all embodiments herein as corresponding traits for non-circle shapes, such as cross-sectional distances and perimeters. It should be understood that various features and aspects of the disclosed embodiments can be combined with or substituted for one another in order to form varying modes of the vanity mirror. Thus, it is intended that the scope of the subject matter herein disclosed should not be limited by the particular disclosed embodiments described above.

The following is claimed:

1. A mirror system comprising:

a protective portion;

a mirror assembly configured to be at least partially received by or in contact with the protective portion in a first stage and completely separable from the protective portion in a second stage, the mirror assembly comprising:

a housing portion;

a mirror coupled with the housing portion;

a light source;

a light conveying channel; and an actuator configured to activate or deactivate the light source when in the second stage there is relative movement between at least a portion of the mirror assembly and at least a portion of the protective portion.

2. The mirror system of claim 1, wherein the protective portion is a holder.

3. The mirror system of claim 1, wherein the mirror assembly comprises a securing portion configured to engage a receiving portion.

4. The mirror system of claim 1, wherein the protective portion comprises a securing portion and/or a receiving portion.

5. The mirror system of claim 4, wherein the securing portion is a snap fastener.

6. The mirror system of claim 4, wherein the securing portion is a zipper.

7. The mirror system of claim 4, wherein the securing portion is a magnet.

8. The mirror system of claim 1, wherein the protective portion is a pouch.

9. The mirror system of claim 8, wherein the pouch comprises front and rear sides with solid surfaces.

10. The mirror system of claim 9, wherein each of the front and rear sides do not include any openings.

11. The mirror system of claim 9, wherein each of the front and rear sides do not include any openings of sufficient size to permit damaging or otherwise impairing contact with the mirror.

12. The mirror system of claim 1, wherein in the first stage the protective portion encloses the mirror assembly on at least a front side or a rear side.

13. The mirror system of claim 1, wherein in the first stage the protective portion encloses the mirror assembly on at least a front side and a rear side.

14. The mirror system of claim 1, further comprising a securing portion that removably secures the protective portion to the mirror assembly.

15. The mirror system of claim 1, further comprising a tab on the mirror assembly that is accessible to the user for pulling the mirror assembly away from the protective portion.

16. The mirror system of claim 1, wherein the actuator comprises a reed switch.

17. A method of using a mirror system, the method comprising:

removing at least a portion of a mirror assembly comprising a front side and a rear side, the front side comprising a mirror, from at least a portion of a holder, the mirror assembly turning on upon at least partial removal from the holder;

viewing a reflection;

returning at least a portion of the mirror assembly to at least a portion of the holder, the mirror assembly turning off upon being at least partially received by the holder, wherein the holder is configured such that when the mirror assembly is completely received by the holder, the holder encloses the mirror assembly on at least the front side of the mirror assembly.

18. The method of claim 17, wherein the step of removing at least a portion of the mirror assembly from at least a portion of the holder comprises completely separating the mirror assembly from the holder.

19. The method of claim 17, wherein the holder is a pouch.

20. The method of claim 19, wherein the pouch comprises solid front and rear surfaces.

21. The method of claim 17, wherein the mirror assembly further comprises an actuator, the actuator comprising a reed switch.

* * * * *